US006398084B2

(12) United States Patent
Maruyama et al.

(10) Patent No.: US 6,398,084 B2
(45) Date of Patent: Jun. 4, 2002

(54) BEVERAGE DISPENSER

(75) Inventors: Fumio Maruyama, Nagoya; Satoshi Takeuchi, Tokai; Kouji Sutou, Oobu; Akira Ogawa; Sukehide Itou, both of Toyoake; Naomoto Amano, Okazaki; Shigekazu Kondou, Toyoake; Satoru Kobayashi, Chita-gun; Shigeaki Tamaki, Ichinomiya, all of (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 0 days.

(21) Appl. No.: 09/773,651

(22) Filed: Jan. 31, 2001

(30) Foreign Application Priority Data

| | | |
|---|---|---|
| Feb. 1, 2000 | (JP) | 2000-024475 |
| Mar. 6, 2000 | (JP) | 2000-061134 |
| Jul. 19, 2000 | (JP) | 2000-219735 |
| Jan. 19, 2001 | (JP) | 2001-012274 |

(51) Int. Cl.[7] ..... B67D 3/00

(52) U.S. Cl. ..... 222/504; 222/505; 222/400.7; 222/400.8; 222/333; 141/192

(58) Field of Search ..... 222/504, 505, 222/400.7, 400.8, 333; 251/52, 291, 11; 141/192

(56) References Cited

U.S. PATENT DOCUMENTS

| | | | | |
|---|---|---|---|---|
| 3,221,936 A | * | 12/1965 | Spinuzza | 222/54 |
| 3,718,233 A | * | 2/1973 | Nordhoff | 222/70 |
| 4,226,343 A | * | 10/1980 | Fling | 222/504 |
| 5,022,557 A | * | 6/1991 | Turner | 222/54 |
| 5,044,528 A | * | 9/1991 | Becker | 222/504 |
| 5,363,989 A | * | 11/1994 | Zeamer et al. | 222/16 |
| 5,431,302 A | * | 7/1995 | Tulley et al. | 222/14 |
| 5,730,323 A | * | 3/1998 | Osborne | 222/55 |
| 5,750,905 A | * | 5/1998 | Weimer et al. | 73/863 |

FOREIGN PATENT DOCUMENTS

JP 409132296 A * 5/1997

* cited by examiner

*Primary Examiner*—Henry C. Yuen
*Assistant Examiner*—Frederick C Nicolas
(74) *Attorney, Agent, or Firm*—Koda & Androlia

(57) ABSTRACT

A beer pouring faucet 14 provided in front of the server main body 12 extends from the faucet main body 18 and includes the operating lever 20 which functions to change pouring of beer or the head by tilting the lever back and forth. The drive apparatus 26 which is capable of automatic operation of the operating lever 20 comprises a housing 32 provided movably vertically with respect to the server main body 12, a horizontally movable slider 34 in forward and backward directions housed in the housing 32 and a drive mechanism 36 which moves the slider 34 forward and backward, The drive apparatus 26 is positioned at an operating position where the operating lever 20 is inserted into the engagement hole 61 of the slider 34 or at a non-operating position where the operating lever 20 is separated from the engagement hole 61 by moving the housing vertically.

9 Claims, 16 Drawing Sheets

(a)

(b)

(a)

(b)

(a)

(b)

BEVERAGE DISPENSER

FIELD OF THE INVENTION

The present invention relates to a beverage dispenser, and more specifically, relates to a beverage dispenser capable of pouring out beverages by manually or automatically operating a lever of a pouring faucet provided in the main body of the dispenser.

DESCRIPTION OF THE RELATED ART

An apparatus for pouring a sparkling beverage by lever operation; for example, a beer server has an operating lever on a beer pouring faucet provided in the main body and some of the beer server has a function, after tilting the lever manually in a predetermined direction to pour a desired amount of beer into a jug, to post-pour frothy beer onto the head of beer in the jug by tilting the lever in the opposite direction. However, when beer and the head are poured out by manual lever operation, there are disadvantages that irregularity of the poured amount due to a difference of operator's skill will occur. Thus, an automatic pouring apparatus disclosed in Japanese Unexamined Patent Publication No. Hei 9-13229 is proposed to automatically operate the operating lever by a drive mechanism. This apparatus is designed such that a drive mechanism provided in the main body and an operating lever on the pouring faucet are linked by a linking mechanism and beer and the head are poured out by moving the operating lever back and forth by operating the drive mechanism.

In the above-mentioned automatic pouring apparatus, since the drive mechanism and the operating lever are linked by the linking mechanism, these components are not easily detachable from each other. Thus. provided that the drive mechanism is locked during beer pouring, it becomes impossible to return the operating lever to the initial position, whereby excess beer or the head is possibly poured out in vain. Further, at the time of breakdown of the drive mechanism, it is difficult to manipulate the operating lever so that a problem is pointed out where the beer server cannot be used until repair is finished. And furthermore, since the drive apparatus is fixedly provided in the main body. a repairman has to repair the drive apparatus under the fixed condition on the main body which leads to a complicated and troublesome operation.

SUMMARY OF THE INVENTION

The present invention is proposed to preferably solve the problems inherent in beverage dispensers according to conventional techniques. It is, therefore, to provide a beverage dispenser being easily detachable from the operating lever of the drive apparatus, capable of easily changing the manual and automatic operations of the lever, and capable of easily removing the drive apparatus from the main body to carry out maintenance outside.

To solve the above-mentioned problems and attain the required objects, a beverage dispenser according to the present invention, which is capable of pouring beverages into a vessel by operating an operating lever of a pouring faucet provided in the main body of the beverage dispenser by means of a drive apparatus, is characterized in that:

the drive apparatus includes drive means that moves an engagement portion, which is detachably engageable with the operating lever, in the operational direction of the lever, and the drive apparatus is positioned at an operating position for the main body where the engagement portion engages with the operating lever, and the drive apparatus is moved so as to estrange the engagement, portion from the operating lever so that manual operation of the lever is permitted.

MODE FOR CARRYING OUT THE INVENTION

Next, a beverage dispenser according to the present invention will be described below using preferable examples thereof with reference to attached drawings. In these examples, beer servers are explained as examples of beverage dispensers. However, they are not limited thereto, and other dispensers that pour other beverages such as juice may be of course used.

Figure 1:
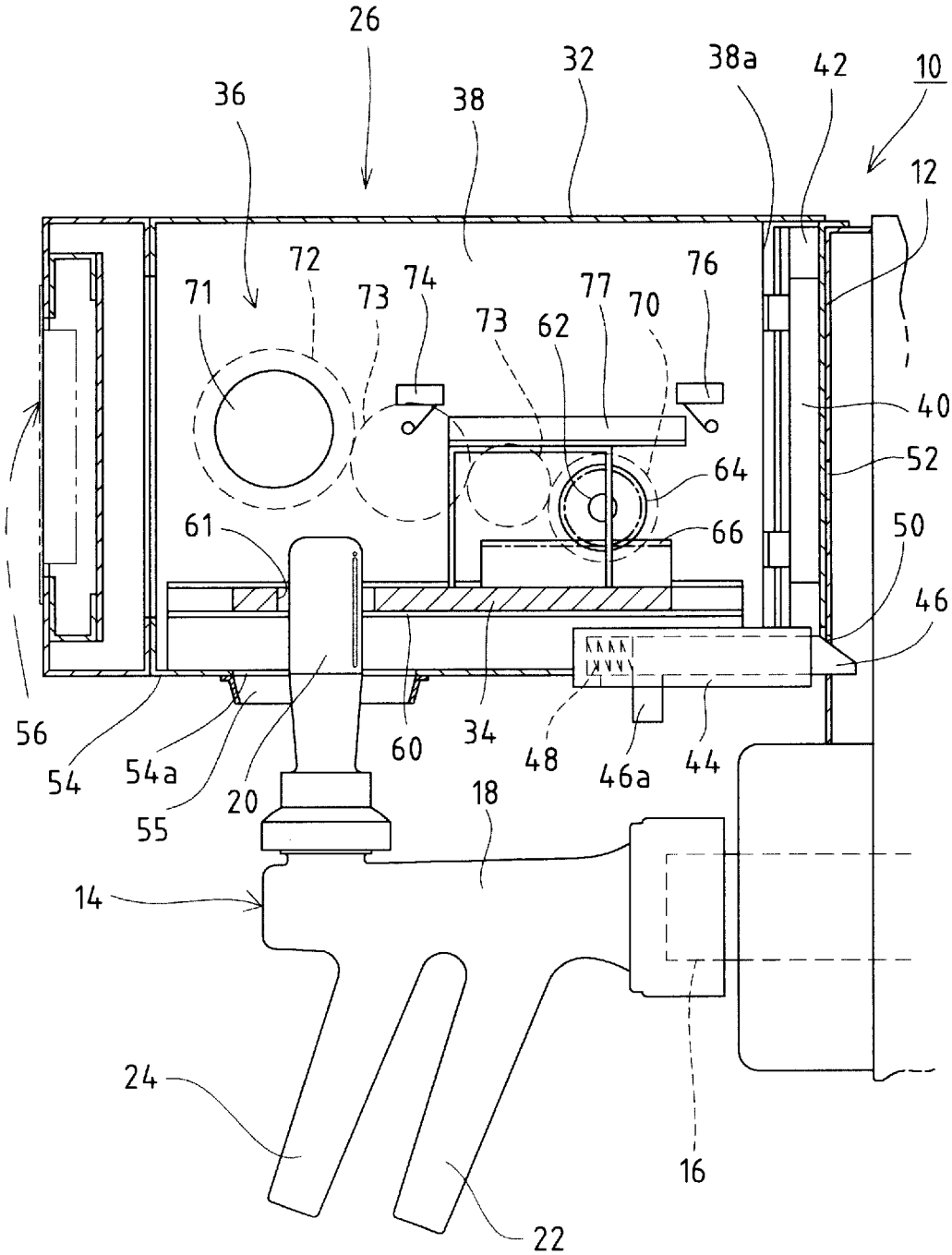
FIG. 1 is longitudinal cross-sectional view showing a drive apparatus provided in a beer server according to a preferable example of the present invention in a state where an operating lever can be automatically operated.

FIG. 1 shows the main portion of a beer server according to a preferable example of the present invention. A beer pouring faucet (referred to as only pouring faucet) 14 is provided in front of the main body 12 of the server 10. To the faucet 14 is connected a beer supply pipe 16 extending in parallel from the main body 12 of the server 10. The beer pouring faucet 14 principally comprises a faucet main body 18 with various integrated types of valve mechanisms (not shown) that opens and closes the path of beer and the head, and an operating lever 20 that is extended upward from the faucet main body 18 and functions to change pouring of the beer or the head by tilting the operating lever back and forth Further, the faucet main body 18 includes a beer pouring spout 22 and a head pouring spout 24 which diagonally extend downward in parallel, and in FIG. 1, the right spout that diagonally extends downward is the beer pouring spout 22 and the left spout is the head pouring spout 24.

In this example, the above-mentioned operating lever 20 is set such that beer is poured out of the beer pouring spout 22 by actuating (opening) the valve mechanism by tilting the lever forward, and the head is poured out of the head pouring spout 24 by actuating (opening) the valve mechanism by tilting the lever backward. In addition, the operating lever 20 is set such that it is always positioned in the neutral position (a fixed position with a substantially vertical posture) between the beer pouring position and the head pouring position at the non-operating time with a spring of the valve mechanism contained in the faucet main body 18 whereby the valve mechanism can be held in an its closed state. Thus, the operating lever 20 is constructed so that it may be automatically operated by a drive apparatus 26 provided on the front surface of the server main body 12.

Figure 5:
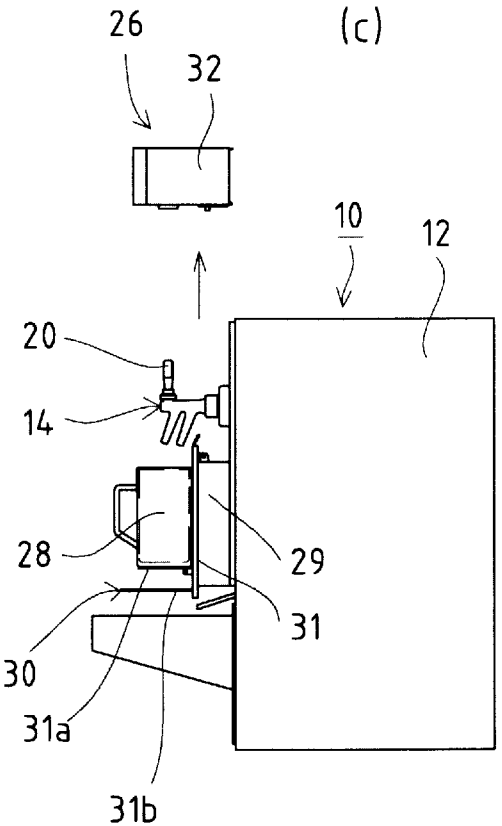
FIGS. 5(*a*) to 5(*c*) are explanatory views showing a positioning position with respect to a server main body of the drive apparatus according to the example and the state of removal of the drive apparatus.
Figure 5:
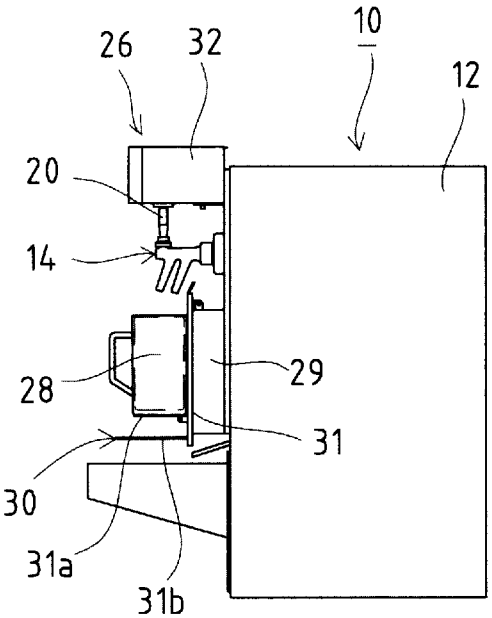
Figure 5:
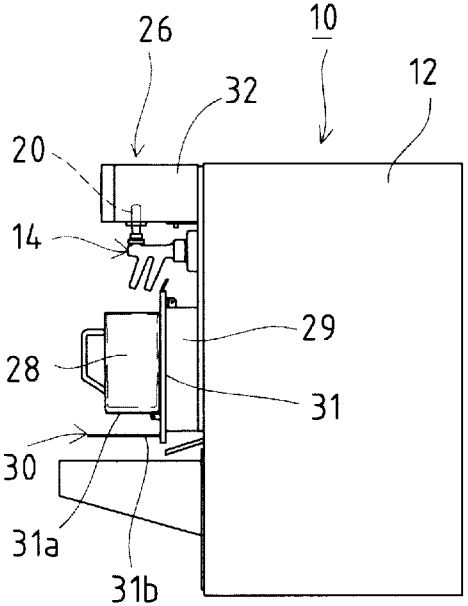

In front of the server main body 12. As shown in FIGS. 5(*a*) and 5(*b*), a vessel receiving device 30 on which a jug (vessel) 28 is positioned is provided under the beer pouring faucet 14, and beer and the head are poured into the jug 28 positioned on the vessel receiving device 30. The vessel receiving device 30 is constructed such that it includes a mounting member 31 pivoted in a tiltable manner on the front side of a cover body 29 provided on the server main body 12 and the mounting member 31 is tilted to a required inclination angle of the lower end of the member 31 by a tilting mechanism (not shown) contained in the cover body 29 while the beer and the head are poured. It should be noted that the mounting member 31 is provided with an upper stand 31*a* and a lower stand 31*b* vertically spaced away from each other, and selected jugs of different sizes can be placed on the stands 31*a* and 31*b*.

(Drive Apparatus)

The drive apparatus 26 that automatically operates the operating lever 20 principally comprises a housing 32 provided movably in the upward and downward directions with respect to the server main body 12, a slider 34 contained in the housing 32 and movable forward and backward horizontally and a drive mechanism (drive means) 36 which allows the slider 34 to move forward and backward in the operating direction of the operating lever 20. The drive apparatus 26 is constructed such that it can be handled in the unit of housing.

(Housing)

Figure 2:
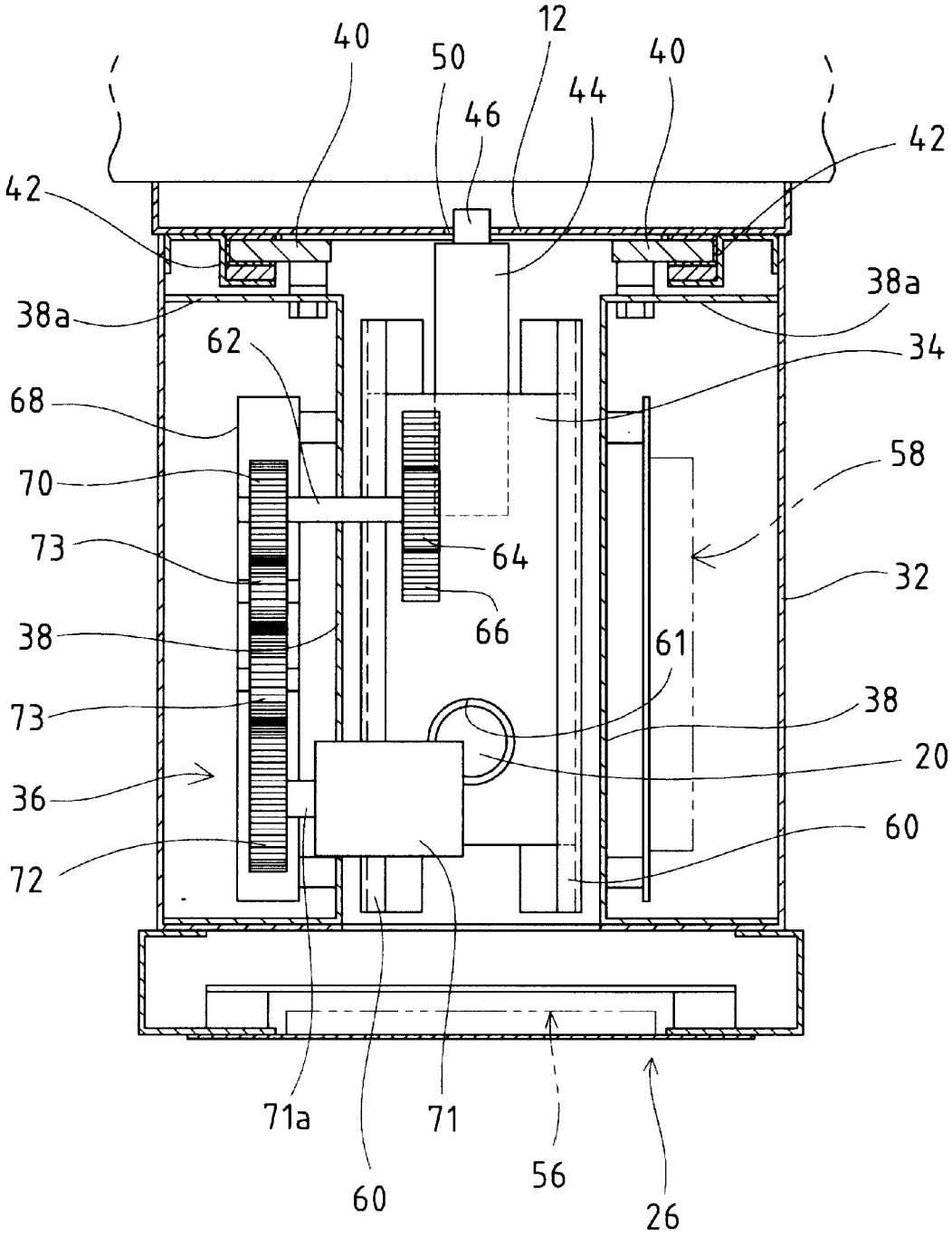
FIG. 2 is a cross-sectional plan view of the drive apparatus according to the example.

Inside the housing 32 are oppositely provided a pair of internal plates 38, 38 each having a C-shaped cross-section, which are spaced away from each other in the width direction of the housing 32, as shown in FIG. 2. On folded portions 38*a* of the respective internal plates 38 facing the front surface of the server main body 12 is provided a slider 40 having a required length vertically, respectively. Further, on the front surface of the server main body 12 are provided a pair of guide portions 42, 42 extending vertically, which are spaced away from each other in the width direction of the housing 32. The corresponding slider 40 is provided on each guide portion 42 such that it is slidable vertically. Each guide portion 42 is formed such that it is opened upward and the upward withdrawal and downward insertion of the slider 40 are permitted (see FIG. 5(*c*)). It is preferable that the vertical movement of the drive apparatus 26 with respect to the server main body 12 is smoothly carried out by applying coating of, for example fluorocarbon resin to the sliding portions of the slider 40 and the guide portion 42, or by making both members of a material having smooth properties such as polyethylene or the like.

On the rear area of the housing 32 is provided a holder 44 between a pair of sliders 40, 40, and on the holder 44 is provided a ratch 46 which is used as the first and second being positioned means such that the ratch 46 is movable forward and backward horizontally. The ratch 46 is designed such that the tip end of the ratch 46 is always extended to the back side of the housing 32 with a compression spring 48 contained in the holder 44. Further, on the ratch 46 is provided a knob control 46*a* extending downward from the holder 44, which permits a manual operation by the use of fingers of an operator, and the ratch 46 can be moved against the elastic force of the compression spring 48 to a position where the tip end of the ratch 46 is displaced on the front side from the rear end of the housing, through the knob control 46*a*.

Figure 4:
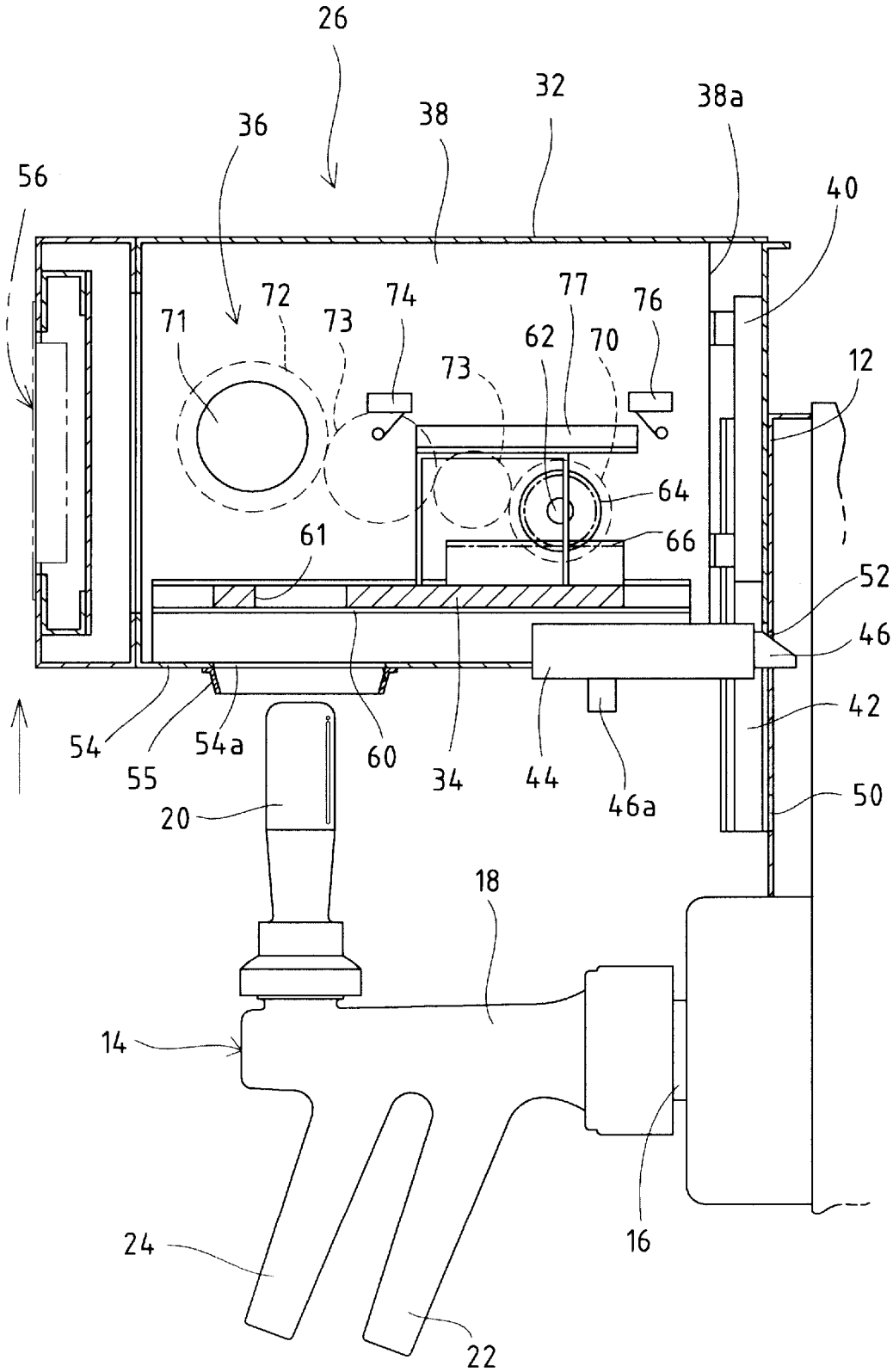
FIG. 4 is a longitudinal cross-sectional view showing the drive apparatus according to the example in a manually operational state by separating it from the operating lever.

Between the pair of guide portions 42 and 42 in the front portion of the server main body 12 are formed a first hole 50 as the first positioning means and a second hole 52 is the second positioning means, spaced vertically from each other which permit the tip end of the ratch 46 to be inserted and engage therewith, as shown in FIG. 1. Then, by the insertion and engagement of the tip end of the ratch 46 to and with the lower first hole 50 the drive apparatus 26 (housing 32) is positioned at an operating position (see FIG. 1), and by the insertion and engagement of the tip end of the ratch 46 to and with the tipper second hole 52 the drive apparatus 26 (housing 32) is positioned it a non-operating position (see FIG. 4). Further, on the bottom plate 54 of the housing 32 is formed a through hole 54*a* having a size which permits the insertion (engagement of the slider 34, which will be described later with the operating lever 20) and tilting of the operating lever 20, which is located at the neutral position. In this case, as shown in FIG. 4, a cylindrical cover 55, whose material is rubber or soft synthetic resin or the like, hanging with length which is not in contact with the operating lever 20, is provided around the outer periphery of the through hole 54*a* with the drive apparatus 26 positioned at the non-operating position. This cover 55 is designed such that the diameter of the cover is gradually reduced on the lower side. Thus, the cover 55 functions so as to prevent finger(s) form entering into the through hole 54*a* easily when the drive apparatus 26 is shifted between the operating position and the non-operating position, or under conditions where the drive apparatus 26 is positioned at the non-operating position. Further, the cover 55 is set to have the necessary minimum size, and is constructed not so as not to lose a good appearance and functions of the drive apparatus 26.

In front of the housing 32 is provided a control panel 56 as an operating portion comprising a pouring button and a pouring amount setting switch and the like, and the control panel 56 is connected to a control substrate 58 provided within the housing 32. By this control substrate 58, the operations of the drive apparatus 26 and the vessel receiving device 30 are controlled.

(Slider)

As shown in FIG. 2, on the upper surface of the bottom plate 54 of the housing 32 are oppositely provided a pair of guide rails 60, 60, spaced away from each other in the width direction of the housing between the pair of internal plates 38, 38. The guide rails 60, 60 extend in the forward and backward directions in a required length. On both guide rails 60, 60, is movably provided a flat plate-shaped slider 34 in the forward and backward directions horizontally. In this slider 34 is formed an engagement hole 61 used as an engagement portion which permits the insertion of the operating lever thereinto. When the drive apparatus 26 is positioned at the operating position, the operating lever 20 is inserted into the engagement hole 61 as shown in FIG. 1, so that the engagement hole 61 engages with the operating lever 20 by the forward or backward movement of the slider 34, and the lever 20 can be tilted in the forward or backward direction. In contrast, when the drive apparatus 26 is positioned at the non-operating position, the engagement hole 61 is shifted upward from the operating lever 20 (as shown in FIG. 4, so that the operating lever 20 can be tilted manually in the forward and backward directions.

The internal diameter of the engagement hole 61 is set at a larger size than that of the outer diameter of the operating lever 20, which is a through passing portion of the lever with respect to the engagement hole 61, as shown in FIGS. 1 and 2. In the conditions where the drive apparatus 26 is positioned at an accurate operating position with respect to the operating lever 20 which is accurately positioned at the neutral position, a desired gap is formed between the outer circumferential surface of the operating lever 20 and the engagement hole 61 in at least the tilting direction of the operating lever 20 (forward or backward direction) as shown in FIGS. 1 and 2. That is, even if the positions of the beer pouring faucet 14 and the drive apparatus 26 with respect to the server main body 12 have a certain error, the beer server 12 is constructed such that the engagement hole 61 of the slider 34 may be fitted to or released from the operating lever 20.

(Drive Apparatus)

The drive apparatus 36 principally comprises a motor, gear trains. and a rack & pinion. A rotating shaft 62 is rotatably supported on the left internal plate 38, and a pinion 64 provided on one end of the rotating shaft 62, which is directed to the right internal plate 38 engages with a rack 66 provided on the upper surface of the slider 34 and extending in the forward and backward directions in a predetermined length. A gear box 68 is provided outside the left internal plate 38, and a driven gear 70 is provided on the other end of the rotating shaft 62 within the gear box 68. Further, a motor 71 is provided on the left internal plate 38, and a drive gear 72 is provided on an output shaft 71*a* of the motor 71 within the gear box 68, so that the drive gear 72 engages with the driven gear 70 through a plurality of intermediate gears 73. Thus, by rotating the pinion 64 in the normal and reverse directions through the motor 71 and the gear trains 72, 73, 73, and 70, the slider 34 provided with the rack 66 engaging with the pinion 64 is horizontally moved in the forward and backward directions along the pair of guide rails 60. 60, so as to be positioned at the forward movement position (see FIG. 3(*a*)) where the operating lever 20 is tilted forward from the neutral position, and at the backward position (see FIG. 3(*b*)) where the operating lever 20 is tilted backward from the neutral position.

It is noted that the slider 34 is designed such that in conditions before the operation of the drive mechanism 36, the slider 34 is positioned at a standby position (the initial state before the operation) where the operating lever 20 at the neutral position can be inserted into the engagement hole 61. Further, the forward movement position and the backward movement position of the slider 34 are set such that the efficient pouring of beer and the head can be executed with the valve mechanism in full open conditions, taking the gap formed between the operating lever 20 and the engagement hole 61 into consideration.

A front detecting switch 74 and a rear detecting switch 76 are provided at the positions above the slider 34 spaced away from each other in the forward and backward directions, in the left internal plate 38. The beer server is set such that the operation control of the motor 71 is executed by actuating the respective switches 74 and 76 by an actuating member 77 provided on the slider 34. That is, the beer server is controlled such that when the actuating member 77 turns the front detecting switch 74 on by movement of the slider 34 from the standby position to the forward movement position, the motor 71 is stopped and after the passage of a predetermined pouring time, the motor 77 is rotated in a reverse direction. In contrast, the beer server is controlled such that when the actuating member 77 turns the rear detecting switch 76 on by movement of the slider 34 from the forward movement position to the backward movement position, the motor 71 is stopped and after the passage of a predetermined pouring time, the motor 77 is rotated in a reverse direction. The stop time of the motor 71 after the slider 34 reached the forward movement position and the backward movement position, is set in accordance with the pouring amounts of beer and the head, which is previously set by the control panel 56. In the case of the beer server 10 of this example, one cycle is defined by a motion that the slider 34 is first moved from the standby position to the forward movement position. it is then moved to the backward movement position and finally it is returned to the original standby position, and the beer server is designed such that beer and the head are poured into the jug 28 during this one cycle.

(Modes or Actions of Example)

Next, the modes or actions of the beer server according to this example will be described below. FIGS. 1 and 5(*a*) show the operating lever 20 of the beer pouring faucet 14 in a state where an automatic operation is controllable by the drive apparatus 26. At this time, the operating lever 20 is at the intermediate position before operation and in a state where the lever 20 is inserted into the engagement hole 61 of the slider 34 positioned at the standby position. Both front and rear detecting switches 74 and 76 are not turned on since they are spaced away from the actuating member 77.

Figure 3:
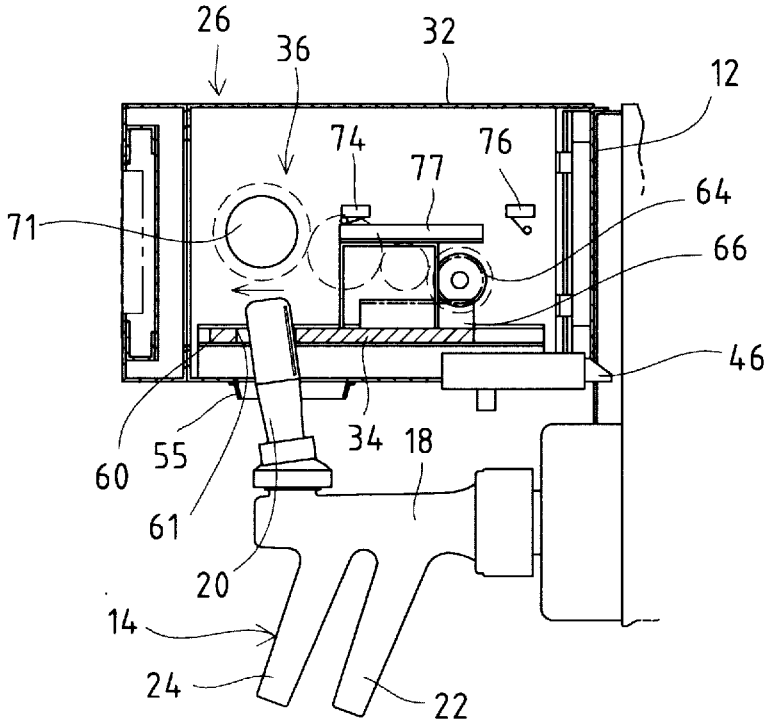
FIGS. 3(*a*) and 3(*b*) are operation explanatory views showing the states of tilting operations of the operating lever in the forward and backward directions by moving a slider of the drive apparatus according to the example in the forward and backward directions.
Figure 3:
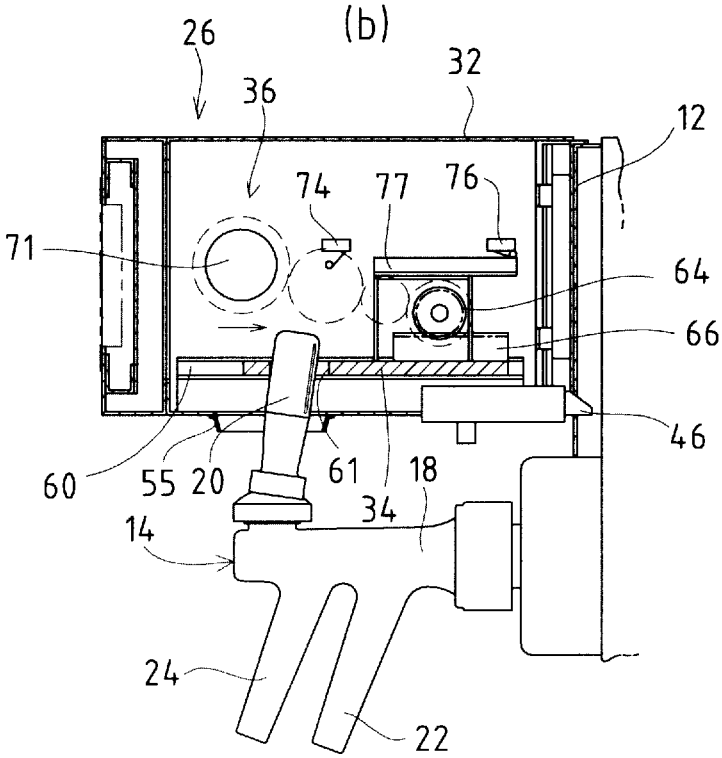

After a jug 28 of the corresponding size is placed on any one of the upper and lower stands 31*a* and 31*b* of the receiving member 31, when the pouring button on the control panel 56 provided in front of the housing 32 is pushed, the tilting mechanism of the vessel receiving device 30 controlled by the control substrate 58 is actuated so that the mounting member 31 is tilted. Thus, the jug 28 placed on the mounting member 31 is in a tilting mode. Then, the motor 71 is rotated in a predetermined direction by the control of the control substrate, and the slider 34 is moved forward along the guide rails 60, 60, through the gear trains 72, 73, 73 and 70, the pinion 64 and the rack 66. The inner circumferential surface of the engagement hole 61 engages with the operating lever 20 with the forward movement of the slider 34, so that the lever 20 is tilted forward, as shown in FIG. 3(*a*). When the slider 34 reaches the forward movement position where the operating lever 20 is tilted to the beer. pouring position. the front detecting switch 74 is turned on by the actuating member 77 so that the motor 71 is stop controlled and the slider 34 is positioned at the forward movement position. As a result, the beer supplied from the beer supply pipe 46 is poured into the jug 28 from the beer pouring spout 22. At, this time, since the jug 28 is in a tilting mode, the beer does not collide against the inside surface of the jug 28 strongly and generation of excess head is prevented.

When a predetermined beer pouring time has passed, the motor 71 is rotated in the reverse direction, so that the slider 34 is returned back from the forward movement position to the backward movement position. The inner circumferential surface of the engagement hole 61 engages with the operating lever 20 with the backward movement of the slider 34, so that the lever 20 is tilted backward, as shown in FIG. 3(*b*). When the slider 34 reaches the backward movement position where the operating lever 20 is tilted to the head pouring position, the rear detecting switch 76 is turned on by the actuating member 77 so that the motor 71 is stop-controlled and the slider 34 is positioned at the backward movement position. As a result, the beer supplied from the beer supply pipe 46 is changed to fine head by the valve mechanism and is added to the beer stored in the jug 28 from the head pouring spout 24.

Then, when a predetermined head pouring time has passed, the motor 71 is rotated again in the reverse direction, so that the slider 34 is moved forward from the backward movement position to the standby position, whereby the operating lever 20 is returned back to the neutral position and at the same time the slider 34 is stop-positioned at the standby position. In this case, even if the relative positions between the operating lever 20 and the drive apparatus 26 are shifted from the normal position, the inner diameter of the engagement hole 61 is set in a size larger than the outer diameter of the operating lever 20, is explained above. Accordingly. a phenomenon of no return of the operating lever 20 to the neutral position due to abutment of the lever 20 on the inner circumferential surface of the engagement hole 61 is prevented. Therefore, the valve mechanism is prevented from keeping the valve mechanism opened and beer and the head do not leak from the respective spouts 22 and 24. Since the cover 55 provided around the outer periphery of through hole 54*a* in the housing 32 is formed such that the diameter of the cover is gradually reduced in its lower portion, the entrance of the beer and head splashes splashed back from the jug 28 into the inside of the housing can be prevented, which permits the prevention of occurrence of an operation failure. When a desired amount of beer and the head is poured into the jug 28, the tilting mechanism is rotated in the reverse direction, so that the mounting member 31 is returned back to the original mode and thus, one cycle pouring operation is completed.

Here, when the drive mechanism 36 is locked by some reasons during pouring the beer or the head, the knob control 46*a* of the ratch 46 is operated to move the ratch 46 backward so as to be separated from the first hole 50, and at the same time the entire drive apparatus 26 is moved upward along the pair of guide portions 42, 42. The drive apparatus 26 is moved to a position where the tip end of the ratch 46 corresponds to the second hole 52, the ratch 46 is extended by the elastic force of the compression spring 48 from the rear end of the housing to engage with the second hole 52. As a result, the drive apparatus 26 is positioned at a non-operating position, as shown in FIGS. 4 and 5(*b*). That is, since the operating lever 20 is separated from the engagement hole 61 of the slider 34, so that the engagement between both members 61 and 20 is released, the operating lever 20 is returned back to the neutral position by the valve mechanism and excess pouring of the beer and head can be prevented. It is noted that since the cover 55 is provided on the outer periphery of the through hole 54*a* in the housing 32, inattentive entrance of a finger from the through hole 54*a* into the inside thereof can be prevented when the drive apparatus 26 is moved from the operating position to the non-operating position.

Further, since the entire operating lever 20 is fully separated from the housing 32 with the drive apparatus 26 positioned at the non-operating position, it is possible to pour the beer and the head by manual tilting operation of the lever 20 by an operator. Further, it is possible to fully remove the drive apparatus 26 from the server main body 12 as shown in FIG. 5(*c*), by moving the entire drive apparatus 26 farther upward with the ratch 46 separated from the second hole 52. As a result, maintenance such as repair, check and the like can be easily performed at different places from the server main body 12. In a structure in which the drive apparatus 26 can be easily separated from the operating lever 20 of the beer pouring faucet 14 as in the present example, an operation for removing the beer pouring faucet 14 from the server main body 12 becomes easy for cleaning the faucet 11, and there is a merit that the beer server can be always kept clean.

The beer server 10 that automatically pours beer and the head by the use of the drive apparatus 26 is designed such that, the pouring amounts (pouring period of time) of the beer and the head are previously set as described above, so that they are poured into the jug 28 by the set amounts. Thus, in a structure of a conventional beer server in which the drive apparatus is not easily separated from the operating lever, even if a different amount of beer or the head is poured only one time, an operation to change the preset pouring amount is required. However, in the beer server 10 of the present example, when a different amount of beer or the head is poured only one time, the drive apparatus 26 is moved to the non-operating position, so that the operating lever 20 may be in a mode where a manual operation is permitted. As a result, the beer server 10 of the present example can be easily adapted without executing complicated operations such as a change in the preset pouring amount and the like.

(Other Examples)

Figure 6:
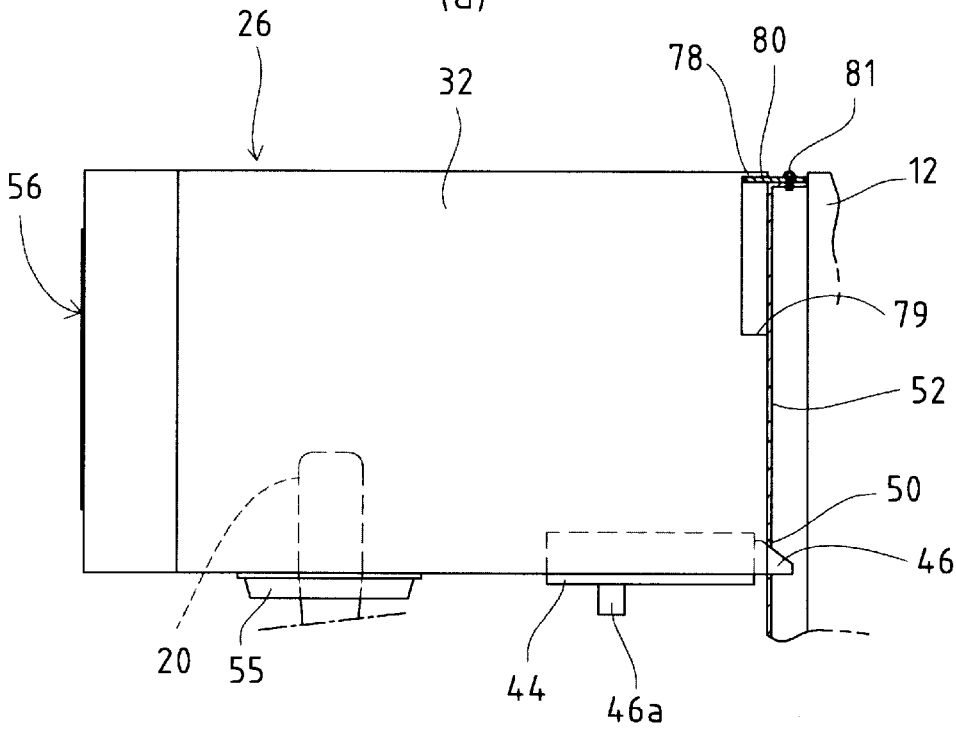
FIGS. 6(*a*) and 6(*b*) are explanatory views showing the main portion of a beer server according to another first example.
Figure 6:
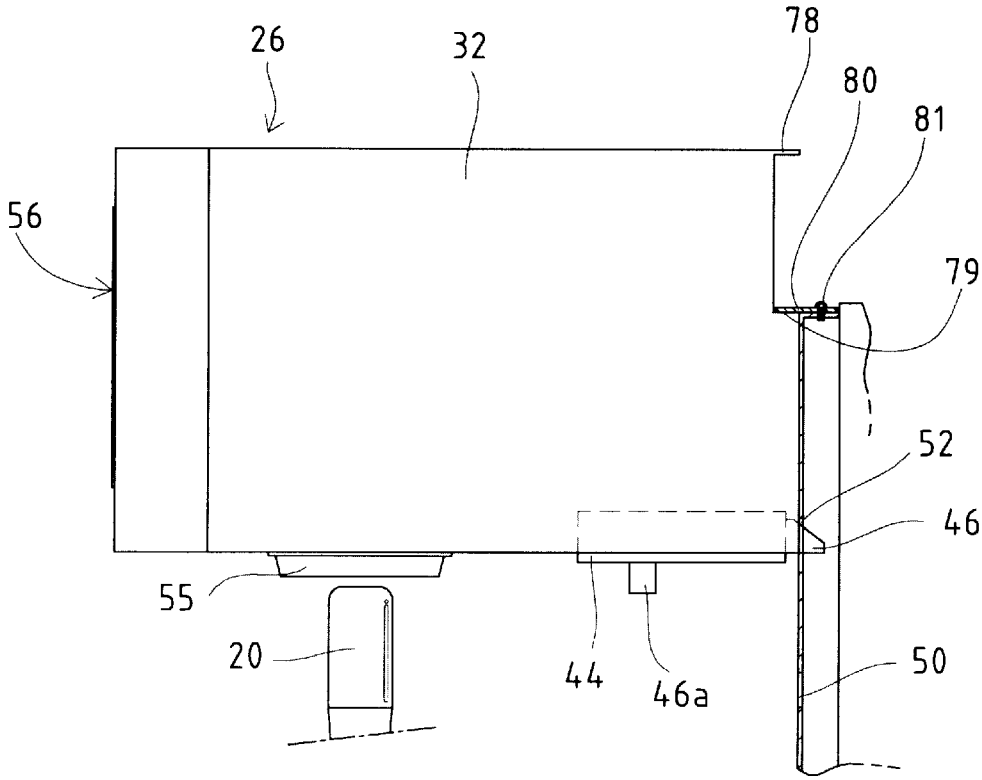

FIG. 6 shows the main portion of a beer server according to another first example. On an upper portion of the rear side of the housing 32 are formed an upper limiting portion 78 and a lower limiting portion 79, spaced away from each other vertically. Further, on the upper portion of the server main body 12 is detachably provided a stopper 80 which is able to engage with both limiting portions 78 and 79 through a screw 81. The upper limiting portion 78 functions to limit that the drive apparatus 26 is lowered from a position where the ratch 46 is inserted into and engages with the first hole 50, by engagement with the stopper 80 from above, as shown in FIG. 6(*a*). In contrast, the lower limiting portion 79 functions to prevent the drive apparatus 26 from being disconnected from the server main body 12 carelessly, by engagement with the stopper 80 from under, as shown in FIG. 6(*b*). Therefore. when the drive apparatus 26 is disconnected from the server main body 12, the stopper 80 is removed from the beer server main body 12 and then the drive apparatus 26 is moved upward. It is noted that in a state where the lower limiting portion 79 is in engagement with the stopper 80, a position of the ratch 46 is set such that the ratch 46 is able to insert into and engage with the second hole 52.

Figure 7:
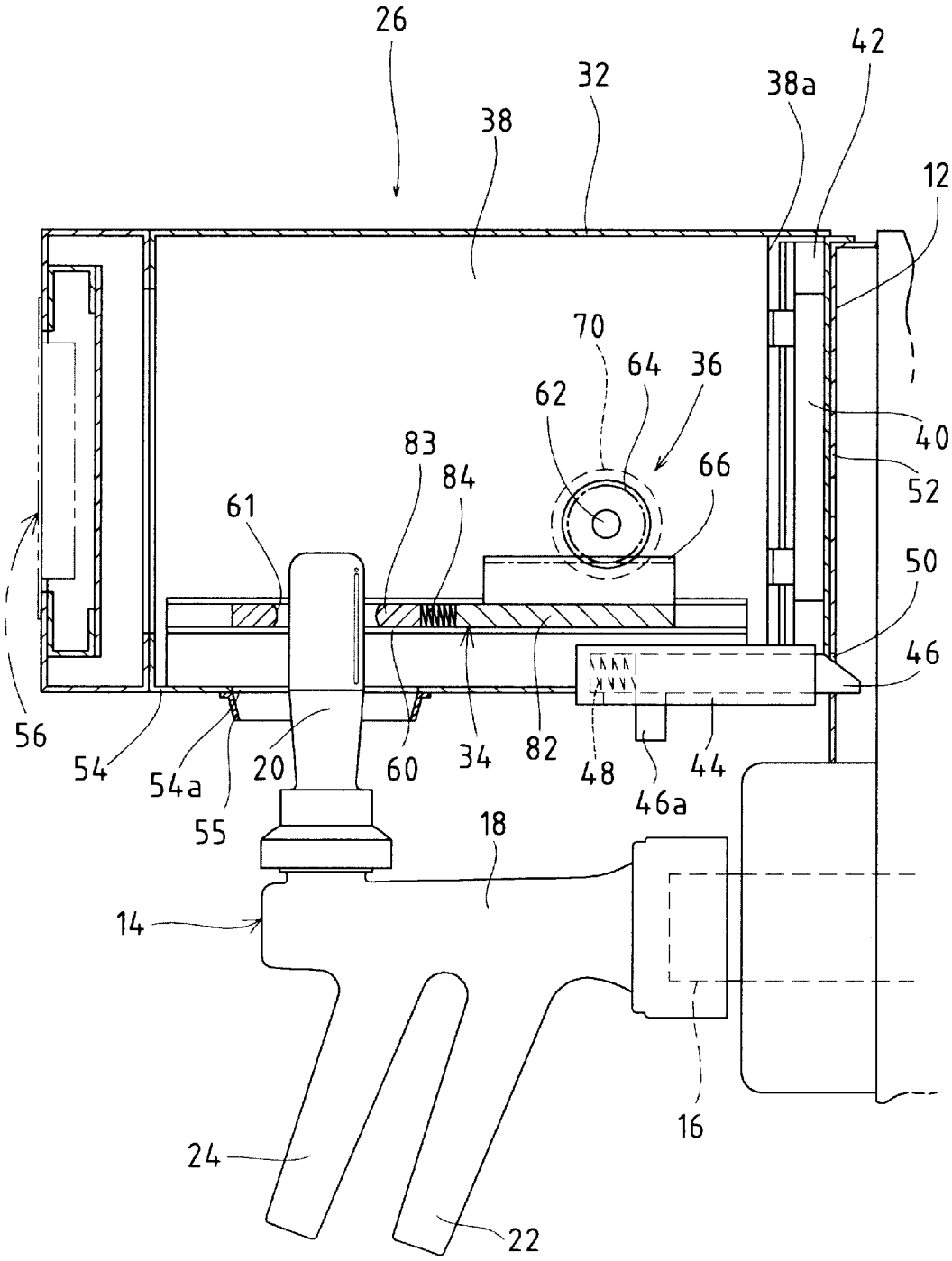
FIG. 7 is in explanatory view showing the main portion of a beer server according to another second example.
Figure 8:
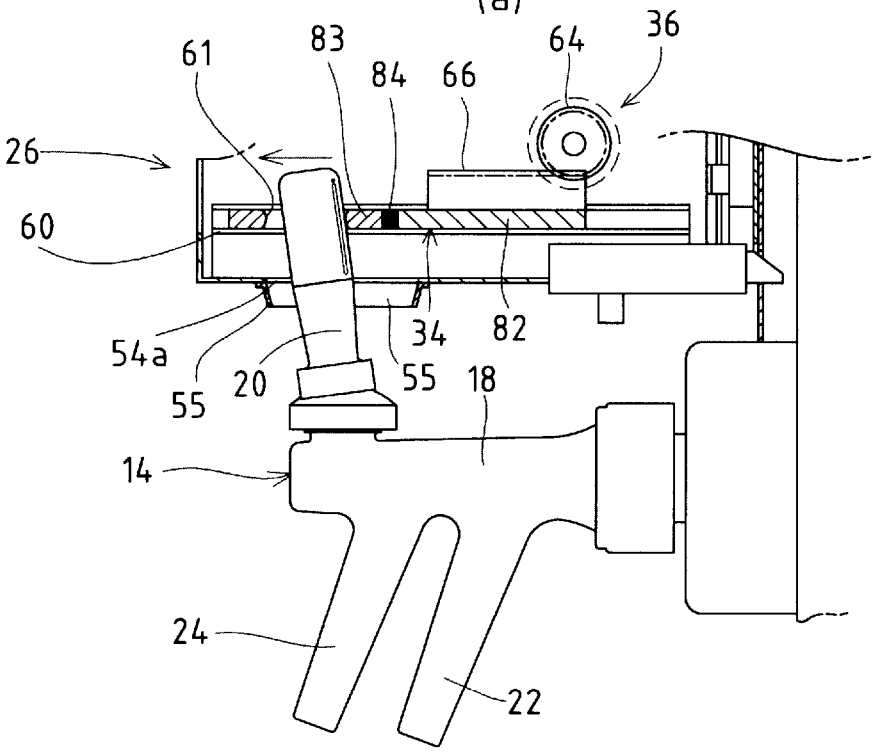
FIGS. 8(*a*) and 8(*b*) are operation explanatory views showing the states of tilting an operating lever in the forward and backward directions by moving a slider of the drive apparatus according to the another second example in the forward and backward directions.
Figure 8:
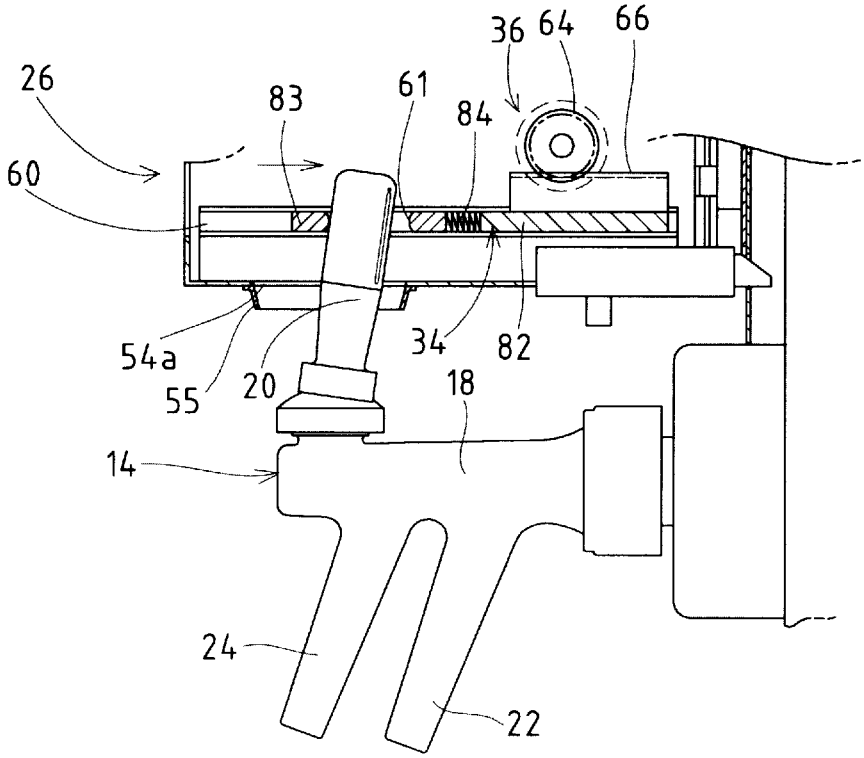

FIGS. 7 and 8 show the main portion of a beer server according to another second example. Since the essential constitution of the beer server is substantially the same as in the above-mentioned examples, only different components of the server will be described. The same reference numerals are denoted to the same members described above.

A slider 34 horizontally movably provided on the pair of guide rails 60, 60 comprises a drive slider portion 82 provided with the rack 66 in mesh with the pinion 64 of the drive mechanism 36, a driven slider portion 83 in which the engagement hole 61 into which the operating lever 20 is inserted is formed, and a compression spring 84 used as a buffer means that connects both slider portions 82 and 83 integrally and movably. The beer server of this example is constructed such that the drive slider portion 82 is moved horizontally along the guide rails 60, 60 by the drive mechanism 36, so that the driven slider portion 83 connected to the slider portion 82 through the compression spring 84 is also moved integrally horizontally, whereby the operating lever 20 is tilted in the forward and backward directions.

When an excess force is not applied to the driven slider portion 83, the compression spring 84 integrally moves the driven slider portion 83 in the started where the relative position of the slider portion 83 with respective to the drive slider portion 82 is not changed. In contrast, when an excess force is applied, the approach and separation of the driven slider 83 from the slider portion 82 is permitted, so that the excess force is not applied to the operating lever 20, the drive mechanism 36 and the like.

In the above-mentioned another second example, when the driven slider portion 83 causes the operating lever 20 to tilt over the limit of the tilting angle, an excess force is applied to the driven slider portion 83 by variations of the working degree of the drive mechanism 36 and the accuracy of assembling other various members, the approach and separation of the driven slider 83 from the slider portion 82 is permitted (see FIGS. 8(*a*) and 8(*b*)) by the expansion and contraction of the compression spring 84. That is, the drive mechanism 36 is prevented from being locked and it can be avoided to apply an excess force to the operating lever 20 or the drive mechanism 36. In addition, by presetting the working degree of the drive mechanism 36 so that the slider 34 is moved slightly further to a position where the beer pouring spout 22 and the head pouring spout 24 can be fully opened, than by a distance which permits tilting of the operating lever 20 forward and backward, it is possible to prevent a phenomenon that the respective spouts 22 and 24 are not fully opened by variations of accuracy of assembling them. Then, to apply an excess force or load onto the operating lever 20 and the drive mechanism 36 is avoided.

Since excess forces are not, applied to the operating lever 20, the drive mechanism 36 and the like, the durabilities of various portions are enhanced. In addition, the friction at the mating portion between the pinion 64 and the rack 66 based on the instant force at the time of actuation of the drive mechanism 36 or at the engagement portion between the engagement hole 61 and the operating lever 20 or the like is a care matter. However, the instant force is uniformed by the elastic force of the compression spring 84 and reduction of the friction can he expected.

Figure 9:
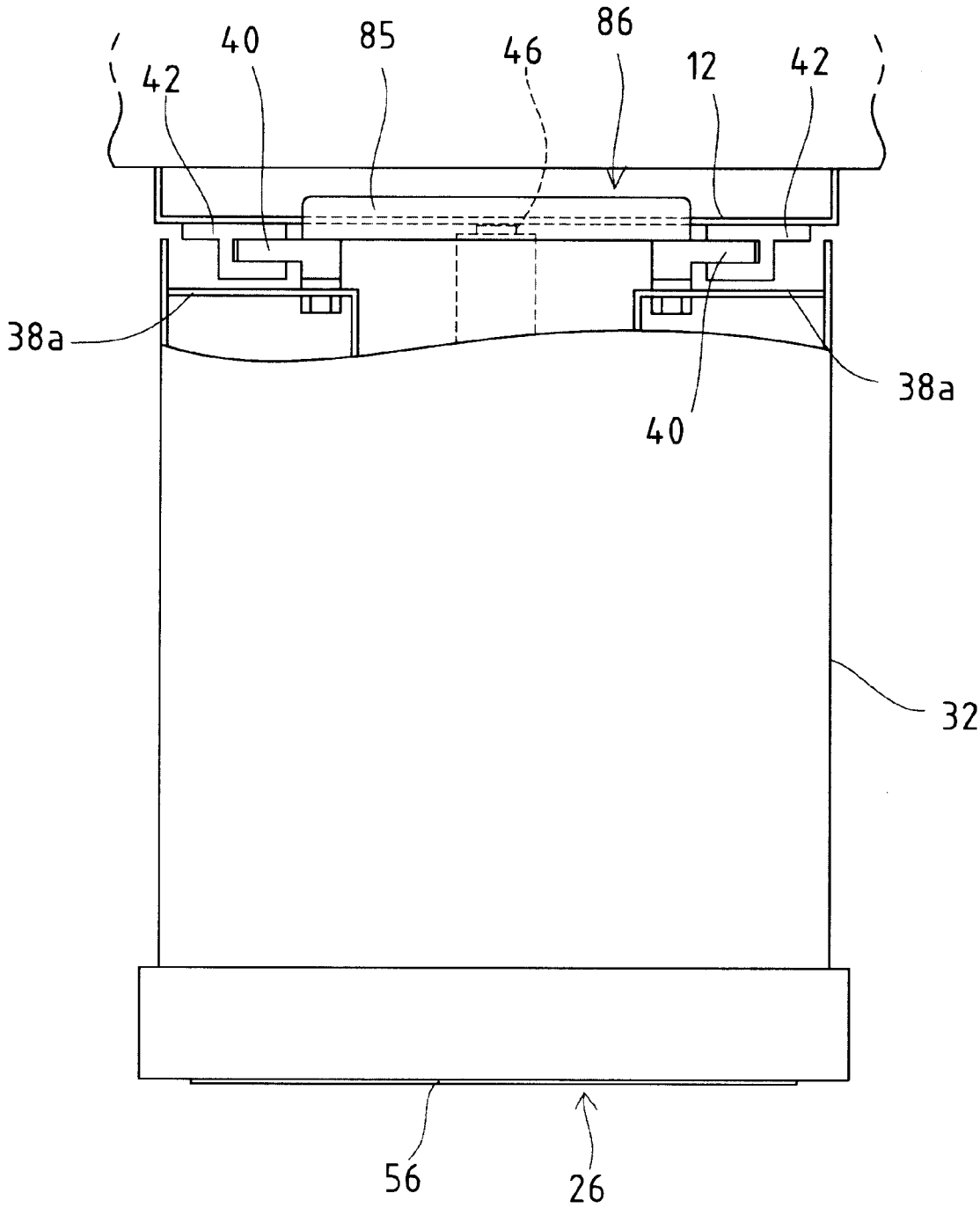
FIG. 9 is a cross-sectional plan view of the partly cutaway main portion of a drive apparatus according to another third example.
Figure 10:
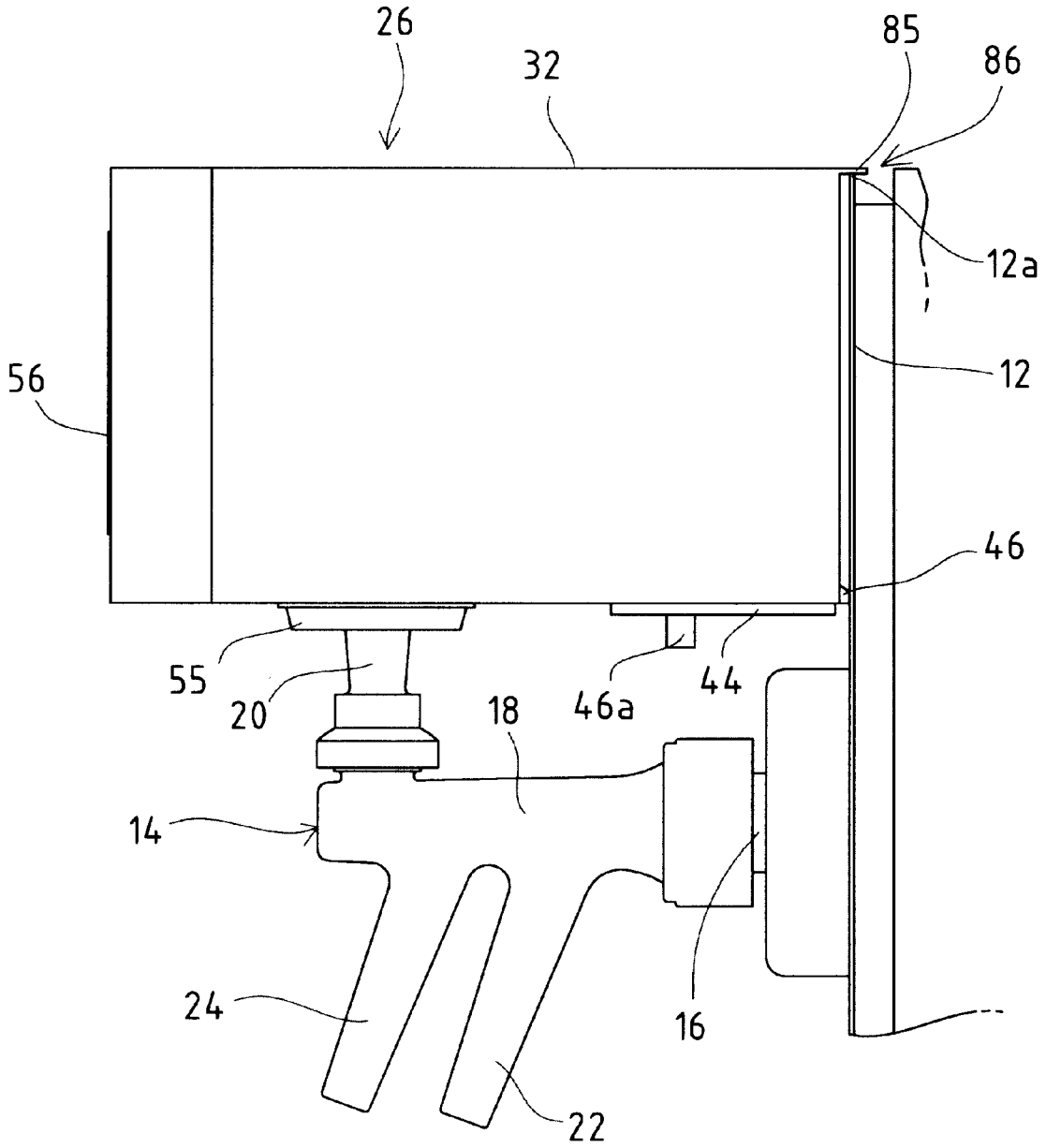
FIG. 10 is a schematic side view of the drive apparatus according to the another third example.
Figure 11:
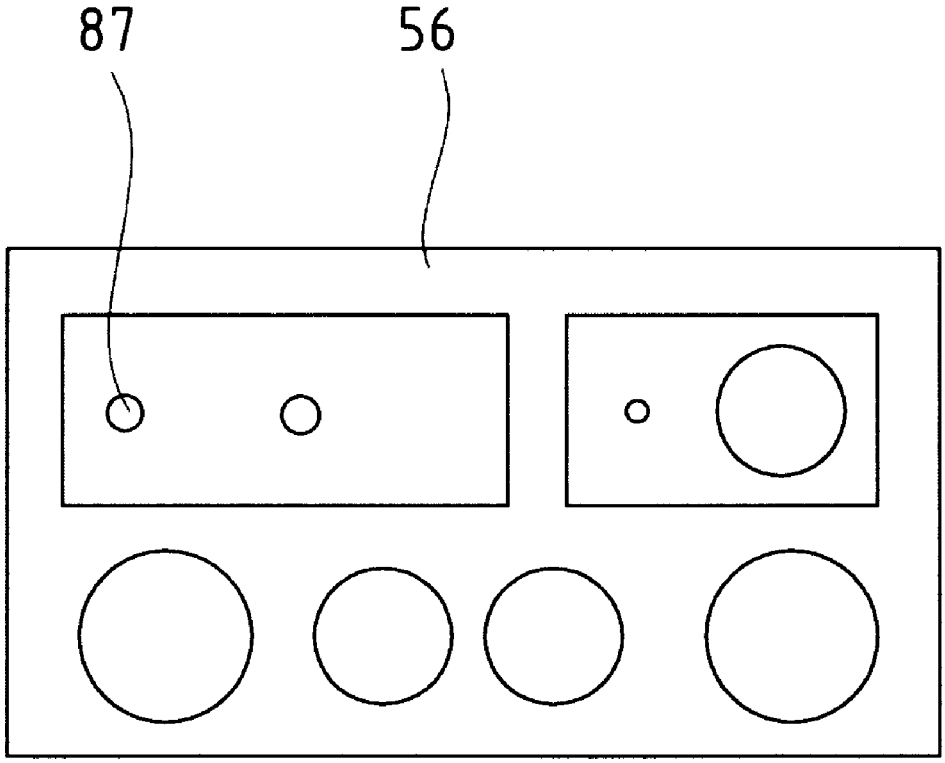
FIG. 11 is a front view showing a control panel of the drive apparatus according to the another third example.

FIGS. 9 to 11 show another third example. The essential constitution of this example is substantially the same as in the examples described above, and only different components will be described. In this case, the same components as those described above are indicated with the same reference numerals is described above.

On the front surface of the metallic server main body 12 are provided a pair of resin guide portions 42, 42 extending vertically, spaced away from each other in the width direction. A resin slider 40 provided on the corresponding internal plate 38 of the housing 32 is slidably vertically provided on each guide portion 42. The housing 32 is movably constructed with respect to the server main body 12 through the guide portion 42 and the slider 40 with electrical isolation. A metallic positioning member 85 used as a first means to be positioned substantially horizontally extending backward by a predetermined length from a surface of the server main body 12 side, is provided between the sliders 40 and 40. In this another third example, the positioning member 85 is abutted to the top end (first positioning means) 12*a* of the server main body 12, so that the drive apparatus 26 is constructed so as to be positioned at an operating position. The positioning of the drive apparatus 26 at the non-operating position is carried out by engaging the same ratch 46 as in the above-mentioned example (which functions as the second means to be positioned) with the second hole (second positioning means) 52. In this case, the ratch 46 is made of resin, and the contact portion between the ratch 46 and the server main body 12 is electrically isolated. Further, in the case of another third example, the first hole 50 is not formed to be used as the first positioning means in the above-mentioned examples, and the tip end of the ratch 46 is abutted on the front surface of the server main body 12 at the operating portion of the drive apparatus 26.

The server main body 12 and the positioning member 85 are constructed such that a slight amount of electric current which has no influence on the human body is passed through them. Thus, the beer server 10 is constructed such that a fact that the drive apparatus has been positioned at an operating position can be detected by the contact between both components 12 and 85, which leads to a case of current carrying. That is, the server main body 12 and the positioning member 85 are used as electrodes and both components 12 and 85 constitute detecting means 86. As explained above, the detecting means 86 is used as an electrode system, and space savings and cost reduction can be further realized compared with a case where additional sensor, switch or the like is provided, and the constitution of the beer server becomes simple. The detecting means 48 is connected to the control substrate 58.

A display lamp 87 which functions as a display portion connected to the control substrate 58 is provided on the control panel 56. This display lamp 87 is set such that it is turned on when the detecting means is in a detecting mode, and it flashes when the detecting means 86 is in a non-detecting mode, and the operator can confirm that the drive apparatus 26 is positioned on the operating position or non-operating position, by the modes of the display lamp 87. Alternatively, when the detecting means 86 is in a non-detecting mode, the display lamp may be turned off.

The control substrate 58 is set such that it deactivates the operations of various buttons and switches on the control panel 56 when the detecting means 86 is in a non-detecting mode. Accordingly, it is possible to prevent an unnecessary operation of the drive apparatus 26 positioned at a non-operating position. In addition, in the non-operating mode, even in a case where a finger possibly enters the through hole 54*a* of the housing 32 even if the cover 55 is provided, the safety in such case is ensured. It is noted that when the drive apparatus 26 is spaced away from the operating position, an operator confirms the case by flashing of the display lamp 87 as described above. Thus. even if the operation of the control panel 56 is deactivated, the operator does not carelessly confirm the case to be a failure of the apparatus 26.

During operation of the drive mechanism 36 in the control substrate 58, that is, while the operating lever 20 is tilting by forward and backward movements of the slider 34, when the drive apparatus 26 is moved from the operating position to the non-operating position, it is operation-controlled for the drive mechanism 36 to cause the slider 34 to return to the standby position (initial state before the operation), provided that the detecting means 86 was changed from a detecting mode to a non-detecting mode. That is, as described above, when the operating lever 20 itself is released from the engagement hole 61 of the slider 34, it is returned back to the neutral position automatically by the valve mechanism. However, when the slider 34 is stopped while it is tilting the operating lever 20 (forward position and backward position), the operating lever 20 does not smoothly insert into the engagement hole 61 of the slider 34 and a load is possibly applied to the slider 34, on then moving the drive apparatus 26 from the non-operating position to the operating position. However, if the slider 34 is always returned back to the standby position as described above, the insertion of the operating lever 20 into the engagement hole 61 can be smoothly carried out, so that the application of the load to the slider 34 can be prevented.

When the detecting means 86 is changed from the detecting mode to the non-detecting mode during operation of the drive mechanism 36, the beer server is designed such that the tilting mechanism is operation-controlled to return the vessel receiving device 30 to the initial state before the operation in the control substrate 58, that is, a state where a surface facing the cover body 29 of the mounting member 31 becomes substantially vertical.

Figure 12:
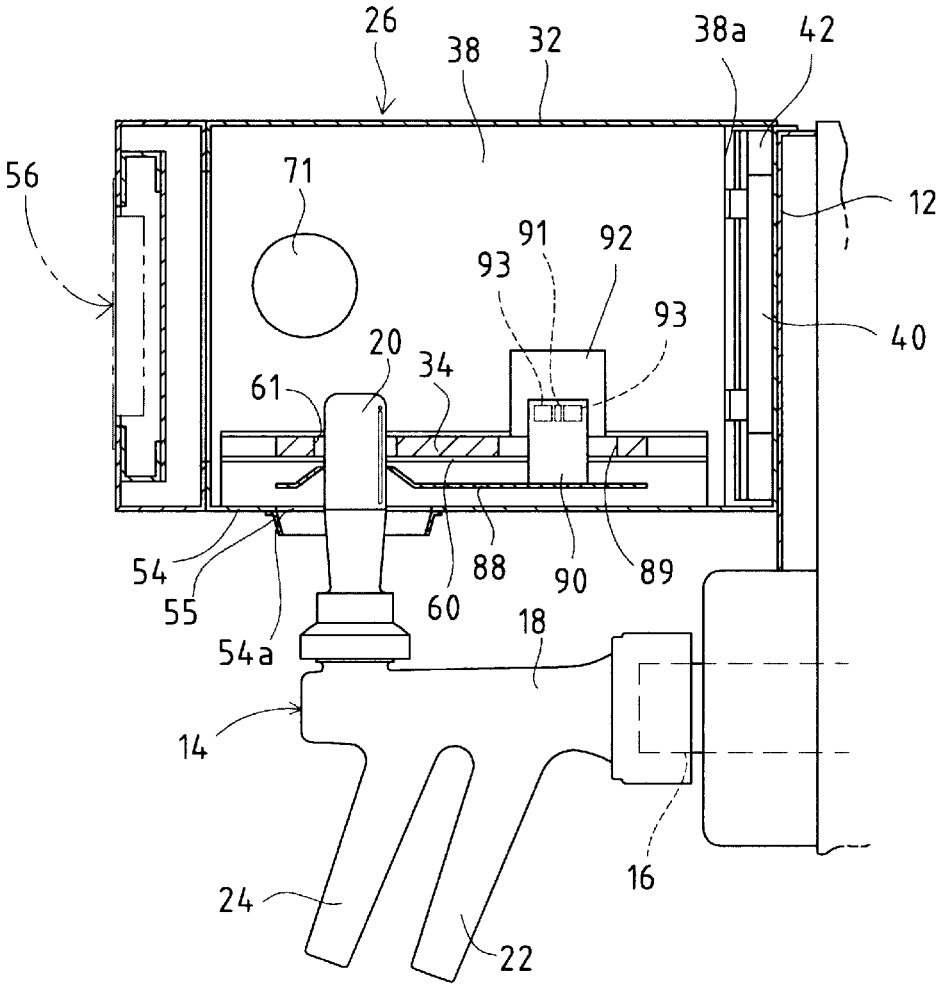
FIG. 12 is a longitudinal side view of a drive apparatus according to another fourth example.
Figure 13:
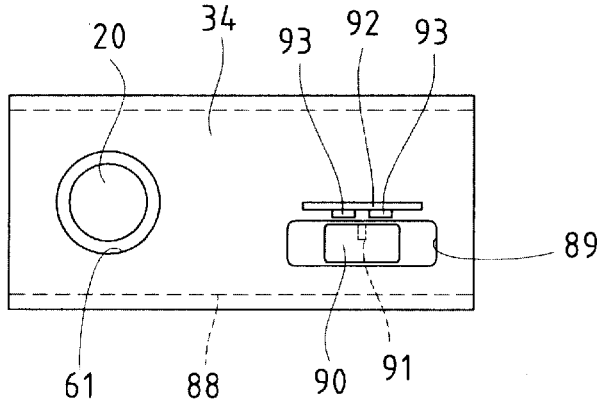
FIG. 13 is a plan view showing a relationship between a hole element and a magnet of the drive apparatus according to the another fourth example.

FIGS. 12 and 13 show another fourth example. The essential constitution of the example is the same as in the examples described above. Thus, only different components will be described. It should be noted that the same components described in the above examples are indicated with the same reference numerals.

In the another fourth example, the motor 71 constituting the drive mechanism 36 includes a position detector (not shown) such as a pulse generator. A pulse from the detector is output to the control substrate 58, and the control substrate 58 is constructed such that the number of revolution and at direction of rotation of the motor 71 are monitored. By rotation-controlling the motor 71 by the number of pulse preset forward and backward with reference to the standby position of the slider 34, the beer server is set such that the slider 34 is moved to the forward movement position and the backward movement position. That is, when the number of pulses of the motor 71, which moves the slider 34 from the standby position to the forward movement position reaches a forward set value with reference to the standby position, the motor 71 is stopped and is rotated in the reverse direction after the passage of a predetermined pouring time, and then the slider 34 is again returned back to the standby position once from the forward movement position. After that, when the number of pulses of the motor 71, which moves the slider 34 to the backward movement position reaches a backward set value with reference to the standby position, the motor 71 is stopped and is rotated in the reverse direction after the passage of a predetermined pouring time.

On the operating lever 20 of the beer pouring faucet 14 is provided an interlocking member 88 that is moved forward and backward integrally with the lever 20 such that the member 88 is positioned under the slider 34. On the interlocking member 88 is vertically provided a holder 90 which is inserted upward into an elongated hole 89 extending in the forward and backward directions, opened in the slider 34. The holder 90 is constructed such that it can be moved relatively in the forward and backward directions with respect to the elongated hole 89. Further, a magnet 91 is provided on an area in the holder 90 above the slider 34. Further, on a mounting plate 92 provided vertically on the top surface of the slider 34 are provided a pair of hole elements 93, 93 which is capable of detecting the magnet 91, spaced away from each other along the direction of movement of the slider 34. Further, when the operating lever 20 is in the neutral position mode, the magnet 91 is set such that it is in the intermediate position between both the hole elements 93 and 93 of the slider 34, which is in the standby position. It is noted that the hole elements 93 and 93 detect distance by magnetic force, and the current position of the magnet 91 is detected by the magnitude of magnetic force detected by the forward and backward hole elements 93 and 93.

In the control substrate 58, the position of slider 34, when the magnet 91 is placed at the intermediate position between the pair of hole elements 93 and 93. is set to be a standby position, and the motor 71 is set such that it is pulse-controlled with reference to the standby position as described above.

That is, in the another fourth example, since the slider 34 is moved to the forward movement position and the backward movement position by pulse-controlling the motor 71, it is possible to omit the forward and backward detecting switches 74 and 76, which actually detect the slider 34 used in the above-mentioned examples. As a result, space savings can be realized. Also. since the another fourth example employs the various constitutions and controls in the another third example, the similar effects such as the capability of recognition of the current conditions of the drive apparatus 26 (operating position and non-operating position) can be obtained.

Figure 14:
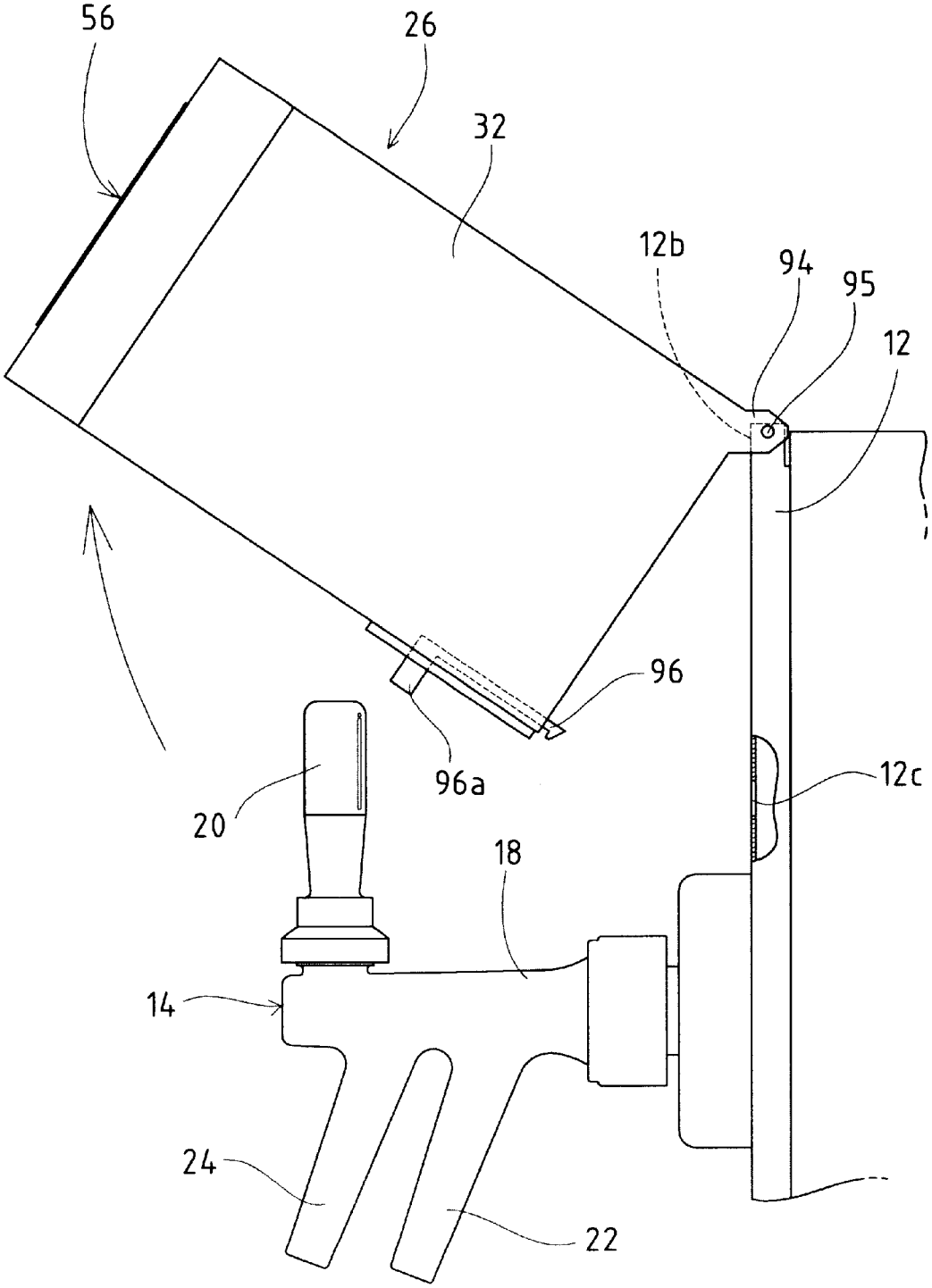
FIG. 14 is a side view showing a state of a drive apparatus according to another fifth example, which is pivoting from the operating position to the non-operating position.
Figure 15:
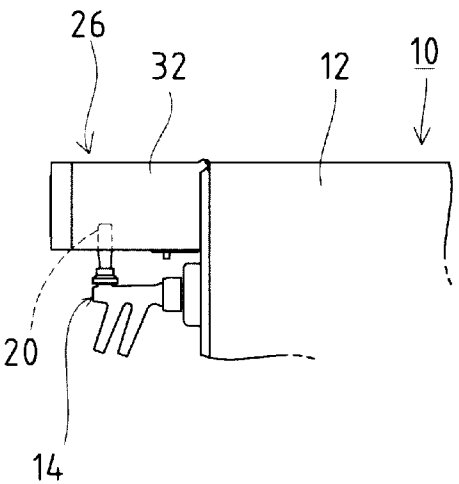
FIGS. 15(*a*) to 15(*c*) are explanatory views showing the pivot state of the drive apparatus according to the another fifth example, pivoting about the server main body.
Figure 15:
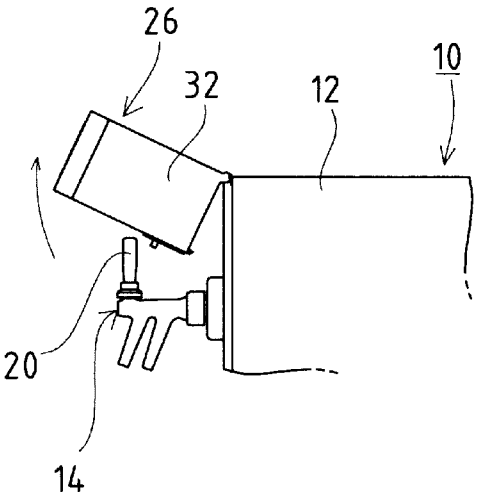
Figure 15:
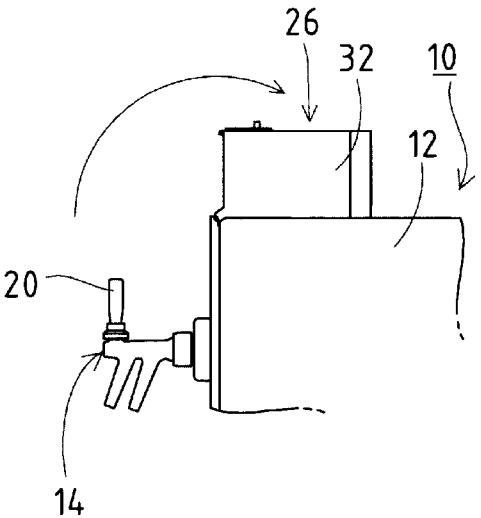

FIGS. 14 and 15 show another fifth example. Since the essential construction is substantially the same as in the examples mentioned above, only different components will be described. It should be noted that the same components described in the above examples are indicated with the same reference numerals.

In the another fifth example, above the pouring faucet 14 the drive apparatus 26 is pivotably provided on the server main body 12. This example is constructed such that the engagement hole 61 of the slider 34 engages with or is released from the operating lever 20 by pivoting the drive apparatus 26. A pair of pivotal support portions 94, 94 (only one shown) extending to the rear side are formed on the upper portion of the housing in the width direction, spaced away from each other, and a supporting shaft 95 pivotably inserted into both the pivotal support portions 94, 94 is insertion-supported on the supporting portion 12*b* provided on the server main body 12. By pivoting the drive apparatus 26 about the supporting shaft 95 counterclockwise as shown in FIG. 14 to allow the rear surface of the housing 32 to engage with the front surface of the server main body 12, the drive apparatus 26 is positioned at the operating position (see FIG. 15(*a*)). In contrast, by pivoting the drive apparatus 26 about the supporting shaft 95 clockwise as shown in FIG. 14 to allow the top surface of the housing 32 to engage with the top surface of the server main body 12, the drive apparatus 26 is positioned at the non-operating position (see FIG. 15(*c*)). As explained above, in the another fifth example, the front surface of the server main body 12 functions as the first positioning means and the top surface of the server main body 12 functions as the second positioning means. In contrast, the rear surface of the housing 32 in the drive apparatus 26 functions as the first means to be positioned and the top surface thereof functions is the second means to be positioned.

The through hole 54*a* formed on the bottom plate 54 of the housing 32 is set to such a size that the bottom plate 54 is not brought into contact with the operating lever 20 positioned at the neutral position during the pivot of the drive apparatus 26. Alternatively, although not shown, the cover 55 may be provided around the outer periphery of the through hole 54*a*. Additionally. the supporting shaft 95 is constructed detachably with respect to the pivotal support portions 94, 94 and the supporting portion 12*b*, and this example is constructed such that the drive apparatus 26 can be removed from the server main body 12 by removing the supporting shaft 95 from both members 94 and 12*b*.

On a rear area of the bottom portion of the housing 32 is movably vertically provided a hook 96 the tip end of which is extending in the backward direction of the housing 32, and the hook 96 is always urged downward by an elastic member (not shown). When the drive apparatus 26 is positioned at the operating position, this hook 96 functions to allow the drive apparatus 26 to hold at the operating position by engaging the front end of the hook 96 with the inner periphery of the supporting hole 12*c* formed at the corresponding position of the front surface of the server body. Further, a pressing piece 96*a* extending downward from the housing 32, which can be operated by fingers of the operator is attached to the hook 96. The pivot of the drive apparatus 26 is permitted by moving the tip end of the hook 96 from the edge portion of the holding hole 12*c* to a position where the tip end is released through the pressing piece 96 while resisting the elastic force of the elastic member. Various interconnections from the server main body 12 to the control panel 58 and the like provided inside the housing 32, are provided through the pivotal support portion between the drive apparatus 26 and the server main body 12, so that the interconnections do not interfere with the pivot of the drive apparatus 26.

In the another fifth example described above, when the drive mechanism 36 is locked by any reason during pouring beer and the head. or when the operating lever 20 is manually operated, the drive apparatus 26 is pivoted clockwise about the supporting shaft 95 with the hook 96 released from the holding hole 12*c* and is positioned at a non-operating position where the top surface of the housing 32 is abutted on the top surface of the server main body 12 to engage therewith. Then, after the release of the lock or the manual operation of the operating lever 20 has been carried out, the drive apparatus 26 is pivoted counterclockwise about the supporting shaft 95, and is positioned at an operating position where the rear surface of the housing 32 is abutted with the front surface of the server main body 12 to engage therewith. As a result, the operating lever 20 is inserted into the engagement hole 61 of the slider 34, thereby enabling an automatic operation of the lever 20. When the drive apparatus 26 is pivoted to the operating position, the drive apparatus 26 is held at the operating position by the engagement of the hook 96 with the inside edge of the holding hole 12*c*.

In the another fifth example constructed described above, in the manual operation of the operating lever 20, as shown in FIG. 5(*c*), the drive apparatus 26 is pivoted to the non-operating position where the top surface of the housing 32 is abutted on the top surface of the server main body 12, and consequently, there is no members which interfere with the manual operation of the lever 20 above the operating lever 20, thereby facilitating the manual operation of the lever 20. Further, the various interconnections between the server main body 12 and the drive apparatus 26 can be united easily by forming the pivotal support portions of both members 12 and 26.

In a construction in which the drive apparatus 26 is slid vertically with respect to the server main body 12 as in the above-mentioned example, it is necessary to provide a desired clearance in the sliding portion. Thus, a slight rattle can occur between the drive apparatus 26 and the server main body 12. In this connection, when the drive apparatus 26 is pivoted with respect to the server main body 12 as in the another fifth example, it is not necessary to provide the clearance, and the drive apparatus 26 is positioned at the operating position with intimate contact with the server main body 12, enabling reduction in rattles.

Figure 16:
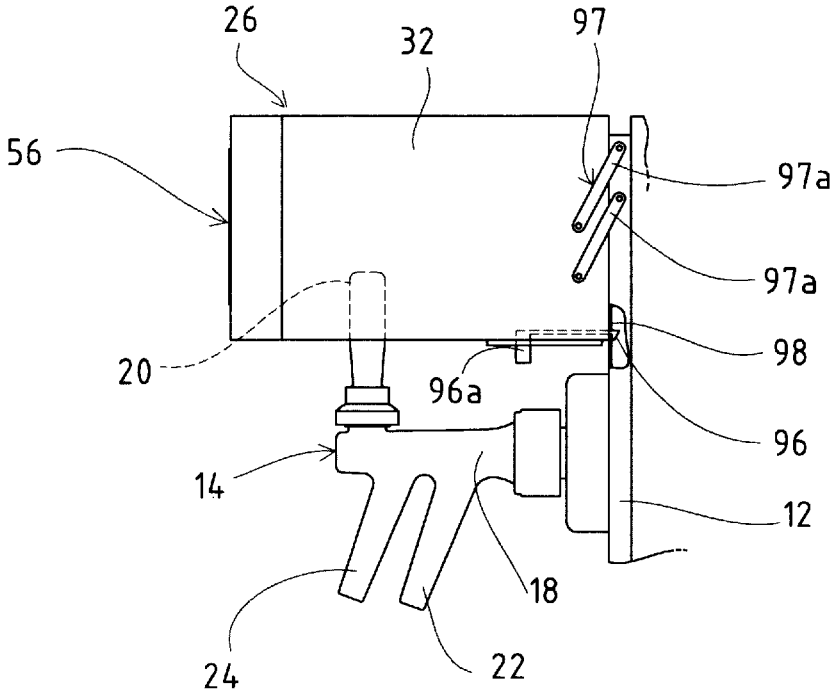
FIG. 16 is a side view showing a drive apparatus of another sixth example in a state positioned at the non-operating position.
Figure 17:
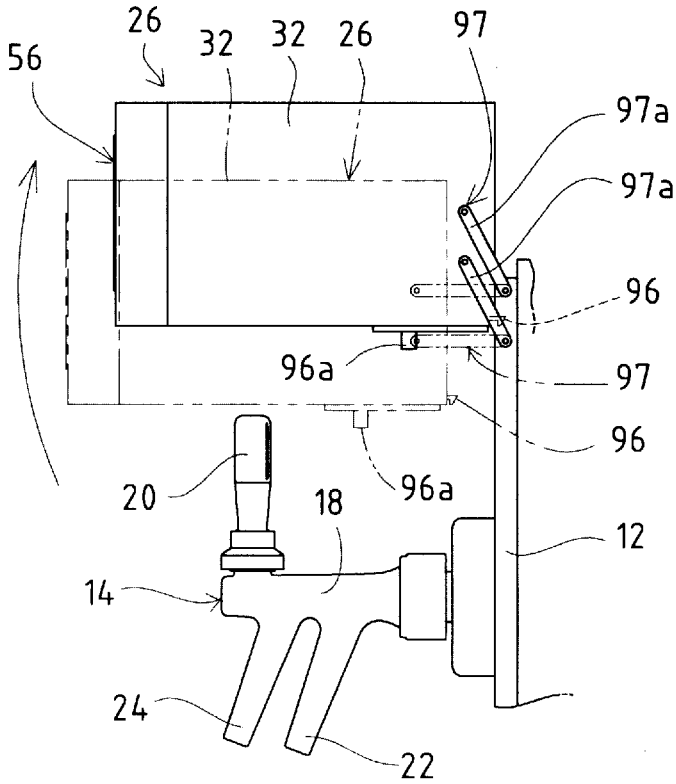
FIG. 17 is a side view showing the drive apparatus of the another sixth example in a state positioned at the non-operating position.

FIGS. 16 and 17 show another sixth example. Since the essential construction is substantially the same as in the examples mentioned above, only different components will be described. It should be noted that the same components described in the above examples are indicated with the same reference numerals.

In the another sixth example, above the pouring faucet 14 the drive apparatus 26 is vertically movably provided on the server main body 12 through a parallel link mechanism 97. This example is constructed such that the engagement hole 61 of the slider 34 engages with or is released from the operating lever 20 by moving the drive apparatus 26 vertically. The respective ends of a pair of upper and lower link rods 97*a*, 97*a* (only one side shown) are pivotably supported between both width directional sides on the rear sides of the housing 32 and the corresponding positions of the server main body 12, respectively. Thus, this example is constructed such that, the drive apparatus 26 is moved vertically in parallel with respect to the server 12 by the parallel link mechanism 97 comprising these four link rods 97*a*, 97*a*, 97*a* and 97*a*. By moving the drive apparatus 26 in parallel counterclockwise in FIG. 16 by the parallel link mechanism 97 to allow the rear surface of the housing 32 to abut on the front surface of the server main body 12 so as to engage therewith, the drive apparatus 26 is positioned at the operating position. In contrast, by moving the drive apparatus 26 in parallel clockwise in FIG. 16 by the parallel link mechanism 97 to allow the rear surface of the housing 32 to abut on the top front surface of the server main body 12 so as to engage therewith, the drive apparatus 26 is positioned at the non-operating position (position shown by the solid line in FIG. 17).

On a rear area of the bottom portion of the housing 32 is provided the same hook 96 (first and second means to be positioned) as in the another fifth example mentioned above, and also on the front, portion of the server main body 12 are formed a lower holding hole 98, with which the tip portion of the hook 96 is capable of engaging in the inside edge portion of the hole, and which functions as a first positioning means, and an upper holding hole (not shown), which functions as a second positioning means spaced vertically from each other. Thus, by engaging the tip portion of the hook 96 with the inside edge portion of the lower holding hole 98, the drive apparatus 26 is set such that it is positioned and held at the operating position (see FIG. 16). Also, by engaging the tip portion of the hook 96 with the inside edge portion of the upper holding hole, the drive apparatus 26 is set such that it is positioned and held at the non-operating position (see FIG. 17). It should be noted that, also in the another sixth example, the through hole 54*a* formed in the bottom plate 54 of the housing 32 is set to such a size that the bottom plate 54 is not brought into contact with the operating lever 20 which is at the neutral position during vertical parallel movement of the drive apparatus 26. Further, the cover 55 may be provided around the periphery of the through hole 54*a*.

In the above described another sixth example, in the case where the drive mechanism 36 is locked by any reason during pouring beer and the head, or in the case where the operating lever 20 is manually operated, when the drive apparatus 26 is moved upward by the parallel link mechanism 97 with the hook 96 spaced from the lower holding hole 98, the housing 32 of the drive apparatus is once estranged (or spaced) from the front surface the server main body 12 while keeping the horizontal posture, and then it is brought near to the front surface of the server main body 12 again. After that, by the abutment and engagement of the rear surface of the housing 32 with the top front surface of the server main body 12, the drive apparatus 26 is positioned at the non-operating position. At this time, the hook 96 engages with the inside edge portion of the upper holding hole and the drive apparatus 26 is held at the non-operating position.

After having executed the release of the lock or manual operation of the operating lever 20, the drive apparatus 26 is moved downward by the parallel link mechanism 97 with the hook 96 spaced from the upper holding hole. Then, the housing 32 of the drive apparatus is once estranged (or spaced) from the front surface the server main body 12 while keeping the horizontal posture, and then it is brought near to the front surface of the server main body 12 again. After that, by the abutment, and engagement of the rear surface of the housing 32 with the front surface of the server main body 12, the drive apparatus 26 is positioned at the operating position. Thus, the operating lever 20 is inserted into the engagement hole 61 of the slider 34, so that an automatic operation of the lever 20 becomes possible. Furthermore, when the drive apparatus 26 is pivoted to the operating position, the hook 96 engages with the inside edge portion of the lower holding hole 98 and the drive apparatus 26 is held at the operating position.

The above-mentioned other fifth and sixth examples can employ various components and controls in the other second and fourth examples. Further, when the drive apparatus 26 is positioned at the operating position, electrode portions provided at suitable positions of the housing and the server main body 12 are brought into contact with each other so that current is passed therethrough. As a result, the same construction as in the another third example that recognizes the current position (the operating position and the non-operating position) of the drive apparatus 26 may also be employed in the other fifth and sixth examples.

Figure 18:
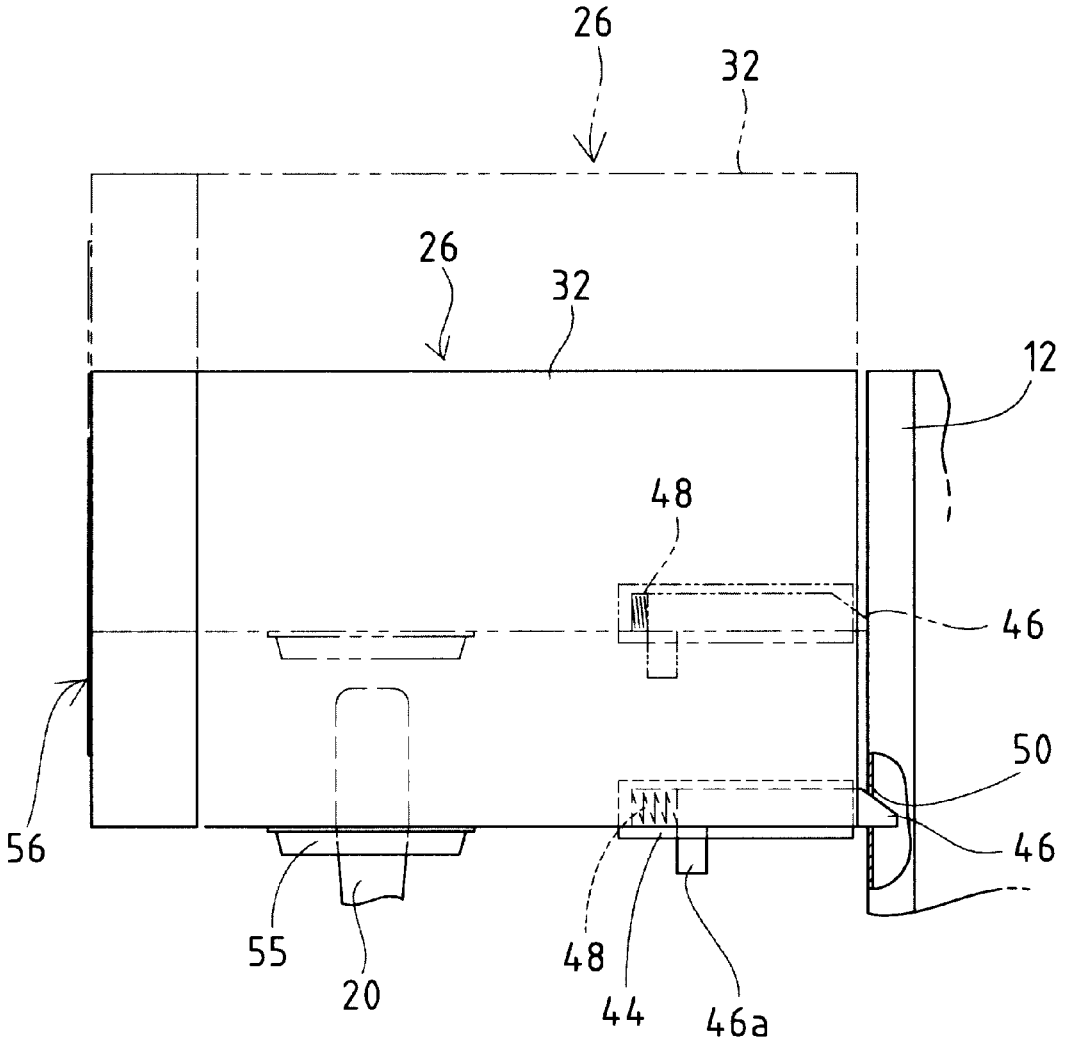
FIG. 18 is a schematic side view showing a drive apparatus according to another seventh example.

FIG. 18 shows another seventh example. Since the essential construction is substantially the same as in the examples mentioned above, only different components will be described. It should be noted that the same components described in the above examples are indicated with the same reference numerals.

In the another seventh example, a first hole 50 that functions as the first positioning means is formed in the beer server main body 12. By inserting and engaging the tip end of the ratch 46, which functions as the first means to be positioned in the drive apparatus 26, with the first hole 50, the drive apparatus 26 is positioned at the operating position (position shown by the solid line). When the drive apparatus 26 is moved to the non-operating position (shown by the two-dotted chain line) with the tip of the ratch 46 spaced from the first hole 50, the tip of the ratch 46 is pressed with the front surface of the server main body 12 by the elastic force of the compression spring 48, so that the drive apparatus 26 is held at the non-operating position. The another seventh example may employ various constructions and controls in the other second and fourth examples mentioned above.

Modification Examples

Although a case of the combined mechanism of the motor, the gear trains and the rack & pinion has been described as the drive means that moves a slider forward and backward horizontally in the above examples, the drive means is not limited to it and various mechanisms may be adopted. For example, the drive means may be one that moves a slider forward and backward by connecting the slider to the motor by a link mechanism or that directly moves a slider forward and backward by the use of an air cylinder, a hydraulic cylinder or the like. In addition, as the engagement portion formed in the slider, not only the hole but also a groove, a recessed portion or the like may be used as long as it has a shape that detachably engage with the operating lever. Further, the means that defines the forward movement position and the backward movement position of the slider may be not only means using the detecting switch as in the examples, but also means that set the rotational time of the motor by a timer. Furthermore. the buffer means that connects the drive slider portion and the driven slider portion is not limited to the compression spring disclosed in the another second example, and it may be a rubber member or other elastic member if it is able to move integrally both slider portions and it permits the approach of both slider portions and the separation thereof from each other when an excess force is applied thereto.

As the detecting means which detects that the drive apparatus has been away from the operating position, various sensors such as a proximity sensor, a photoelectric sensor and the like can be used in place of the detecting means which detect by the current carrying state between the server body and the positioning piece in the another third example. Alternatively, as the display portion, not only the lamp but also LED, liquid crystal or the like may be used. It is noted that various constructions and controls of the other third and fourth examples are appropriately used in the other first, and second examples. Further, the above-mentioned respective examples have been explained in a type for a pouring faucet in which the operating lever for a pouring faucet is extended upward from the faucet body. However, in a type in which the operating lever is extended forward or sideward from the faucet body and is tilted vertically or laterally the operating apparatuses according to various examples mentioned above can be used for the operating lever by providing the apparatus at a suitable position.

Effects of the Invention

As described above. according to the beverage dispenser according to the present invention, the drive apparatus that operates the operating lever can be switched into a mode in which an operation of the operating lever is possible and a mode in which a manual operation is possible. That is, when the drive means and the like are locked by any reason during pouring operation, the drive apparatus can be separated from the operating lever only by moving the operating position. Accordingly, it is possible to prevent beverages from being poured excessively by keeping the lever in a pouring mode.

In addition, if the drive apparatus is moved from the operating position so that the engagement portion may be estranged from the operating lever, a manual operation of the operating lever becomes possible. Thus, even while executing maintenance of the drive apparatus such as repair and the like, the pouring of beverages can be carried out manually. Further, only by moving the drive apparatus vertically with respect to the beer server body or pivoting it, the drive apparatus can be easily positioned to an operating position where the operation of the operating lever is enabled, and a non-operating position where the manual operation is enabled. Further, when the beer server is constructed such that the drive apparatus is pivoted about the server body, the interconnections which connect the server body to the drive apparatus can be easily united and it is possible to prevent occurrence of rattle between both members. Furthermore, since the drive apparatus is fully removed from the server body, it becomes possible to execute its maintenance easily at places separated from the server body.

According to a construction of the beer server constructed by the drive slider portion and the driven slider portion connected to each other with a buffer means, it is possible to avoid the application of an excess force to the drive means and the operating lever due to variations of the movement of the slider by the drive means and of accuracies of assembling various members, enabling the long service life of the parts. Therefore, since high assembling accuracy is not required for various members, the assembling operation becomes easy.

By providing the detecting means which detects positioning of the drive apparatus it, the operating position, operation of the operating portion that actuates the drive means is deactivated in a non-detecting mode of the detecting means and it is possible to prevent useless operation of the drive apparatus in the non-operating position. In addition, by displaying the non-detecting mode of the detecting means in a display portion, the state can be reliably recognized by the operator. Further, when the detecting means has been changed from the detecting mode to the non-detecting mode during operation of the drive means, a movement of the drive apparatus from the non-detecting position to the detecting position in a state where the engagement portion is kept being stopped, is not carried out by returning the engagement portion to the initial state before operation. That is, while the operating lever is constructed such that it is always returned back to a fixed position during the non-operation, the engagement portion is also always returned back to an engageable fixed position. As a result, an engagement of the engagement portion with the operating lever is smoothly carried out.

Additionally, by providing a cover a round the outer periphery of the through hole in the housing of the drive apparatus, it is possible to prevent a finger from entering the through hole carelessly during the movement of the drive apparatus between the operating position and the non-operating position. Further, in pouring beer and the head into a vessel, the splashes of the beer and head splashed from the vessel can be prevented from entering the inside of the housing and therefore, the occurrence of operation failure of the drive means can be prevented.

What is claimed is:

1. A beverage dispenser capable of pouring beverages into a vessel by operating an operating lever of a pouring faucet provided in a main body of the beverage dispenser by means of a drive apparatus, wherein said drive apparatus includes drive means that is housed in a housing that is detachably provided on said main body and moves an engagement portion, which is detachably engageable with said operating lever, in an operational direction of lever, a first positioning means is provided on said main body;

a first being positioned means is provided on said housing;

said engagement portion housed in said housing is positioned, by way of disengageably engaging said first positioning means with said first being positioned means, at an operating position where said engagement portion engaged with said operating lever, and said housing is moved from said main body, by way of disengaging said first being positioned means from said first positioning means, so as to estrange said engagement portion at said drive means from the operating lever so that manual operation of the operating lever is permitted.

2. The beverage dispenser according to claim 1, wherein said drive apparatus that comprises the housing is movably provided above said pouring faucet in the vertical direction with respect to the main body and said housing is selectively positioned at said operating position and at a non-operating position where said engagement portion is upwardly estranged from said operating lever to permit manual operation of the lever.

3. The beverage dispenser according to claim 1, wherein said drive apparatus that comprises the housing is pivotably provided above said pouring faucet with respect to the main body and said housing is selectively positioned at said operating position and at a non-operating position where said engagement portion is upwardly estranged from said operating lever to permit manual operation of the lever.

4. The beverage dispenser according to claim 1, wherein said drive apparatus includes a slider which is moved forward and backward in the operational direction of the operating lever by said drive means, said slider comprising a drive slider portion movably linked back and forth to said drive means, a driven slider portion on which said engagement portion is formed and buffer means which connects both slider portions integrally movable and permits approaching and estranging movement of the driven slider portion against the drive slider portion.

5. The beverage dispenser according to claim 1, wherein said drive apparatus that comprises the housing includes detecting means which detects whether said drive apparatus is positioned at the operating position.

6. The beverage dispenser according to claim 1, wherein a through hole permitting a passing through of said operating lever is formed in a bottom plate of said housing for the drive apparatus housing said drive means, and the outer periphery of the through hole is provided with a cover which has a length that does not make contact with the operating lever under a condition where said drive means is brought into a non-operating position.

7. The beverage dispenser according to claim 5, wherein said drive apparatus that comprises the housing includes an operating portion which actuates said drive means, and is set such that the operation of the operating portion is deactivated in a non-detecting mode of said detecting means.

8. The beverage dispenser according to claim 7, wherein said drive means is actuated to return said engagement portion to the initial state when said detecting means is changed from the detecting mode to the non-detecting mode during the operation of the drive means.

9. The beverage dispenser according to claim 7, wherein a display portion is provided in said drive apparatus to display said detecting means being in the non-detecting mode.

* * * * *